US006229515B1

(12) United States Patent
Itoh et al.

(10) Patent No.: US 6,229,515 B1
(45) **Date of Patent: *May 8, 2001**

(54) LIQUID CRYSTAL DISPLAY DEVICE AND DRIVING METHOD THEREFOR

(75) Inventors: Goh Itoh, Tokyo; Haruhiko Okumura, Fujisawa, both of (JP)

(73) Assignee: Kabushiki Kaisha Toshiba, Kawasaki (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/766,854

(22) Filed: Dec. 13, 1996

(30) Foreign Application Priority Data

Jun. 15, 1995 (JP) ..... 7-148832
Dec. 13, 1995 (JP) ..... 7-324606

(51) Int. Cl.[7] ..... G09G 3/36

(52) U.S. Cl. ..... 345/103; 345/89; 345/96; 345/100; 345/209

(58) Field of Search ..... 345/94, 96, 99, 345/100, 150, 151, 152, 103, 209, 89

(56) References Cited

U.S. PATENT DOCUMENTS 4,789,223 * 12/1988 Kasahara et al. ..... 350/332
5,233,447 * 8/1993 Kuribayashi et al. ..... 345/97
5,252,959 * 10/1993 Kono ..... 345/147
5,262,881 * 11/1993 Kuwata et al. ..... 359/55
5,488,388 * 1/1996 Taniguchi et al. ..... 345/97
5,565,883 * 10/1996 Shimizu ..... 345/94
5,576,729 * 11/1996 Yamazaki ..... 345/94
5,592,190 * 1/1997 Okada et al. ..... 345/89
5,642,128 * 6/1997 Inoue ..... 345/96
5,691,740 * 11/1997 Onitsuka et al. ..... 345/96
5,734,364 * 3/1998 Hirai et al. ..... 345/95
5,734,367 * 3/1998 Tsuboyama et al. ..... 345/101
5,748,165 * 5/1998 Kubota et al. ..... 345/96
5,777,592 * 7/1998 Mihara et al. ..... 345/94
5,777,593 * 7/1998 Kondoh ..... 345/97
5,831,586 * 11/1998 Hirai et al. ..... 345/96
5,844,534 * 12/1998 Okumura et al. ..... 345/90

FOREIGN PATENT DOCUMENTS 3-271795 12/1991 (JP) .
6-222330 12/1994 (JP) .

* cited by examiner

*Primary Examiner*—Richard Hjerpe
*Assistant Examiner*—Henry N. Tran
(74) *Attorney, Agent, or Firm*—Pillsbury Winthrop LLP

(57) ABSTRACT

A liquid crystal display device includes a pair of substrates, on at least one of which pixels or scanning lines and switching elements for selecting desired pixels or scanning lines are arranged, a liquid crystal material sandwiched between the substrates, a driving means for driving a pixel group arrayed on each of selected scanning lines with the same polarity, and a polarity reversal means for compensating for flickers by reversing the polarity. In the display area, the scanning line selection order is arbitrarily determined, and the polarities are reversed on the basis of the determination result so as not to produce a bundle of scanning lines having the same polarity within one field.

13 Claims, 27 Drawing Sheets

H : F1 IS SELECTED

L : D1 IS SELECTED

TIME →

TIME →

LIQUID CRYSTAL DISPLAY DEVICE AND DRIVING METHOD THEREFOR

BACKGROUND OF THE INVENTION

1. Field of the Invention

The present invention relates to a liquid crystal display device having selection switching elements arranged in units of pixels or scanning lines, and a driving method for the device.

2. Description of the Related Art

Liquid crystal display devices are low-profile, lightweight devices which can be driven on low voltages, and hence are widely used for wristwatches, desk calculators, wordprocessors, personal computers, compact video games, and the like. With the recent, increased demand for pen input electronic notebooks, a demand has arisen for portable terminal devices (PDA).

As a method of driving a liquid crystal display device, a driving method of reversing the polarities within the same frame is available. This driving method includes a signal line reversal method of reversing the polarity in units of signal lines, a horizontal polarity reversal (to be referred to as H reversal hereinafter) method of reversing the polarity in units of scanning lines, and a dot reversal method of reversing the polarity between adjacent pixels. These driving methods can compensate for flicker components (e.g., plane flickers) resulting from polarity reversal. The H inversion driving method has been widely used especially as the demands have arisen for arrangement of signal line drivers on one side with a decrease in cabinet size, and for low-withstand voltage drivers for a decrease in power consumption.

In a large-screen, high-resolution LCD, as the number of signal lines increases, the capacitive component between the common electrode and each signal line becomes large. In addition, the resistive component greatly changes in accordance with the distance from the feeding point because of the sheet resistance of the common electrode. For this reason, when the polarity of the common electrode is reversed, since the time constant of the common electrode varies within the frame as shown in FIG. 1, the voltage value of the common electrode varies (the waveform becomes blunt). Since this phenomenon depends on the signal voltage, when window display is performed, picture degradation known as crosstalk occurs. In order to solve this problem, the sheet resistance of the common electrode may be decreased. However, this method has its own limitations, and cannot provide a satisfactory effect.

SUMMARY OF THE INVENTION

The present invention has been made in consideration of the above situation, and has as its object to provide a liquid crystal display device and a driving method therefor, which can prevent picture degradation such as crosstalk.

According to the present invention, there is provided a liquid crystal display device comprising:

a pair of substrates, on at least one of which pixels or scanning lines and switching elements for selecting the pixels or the scanning lines are arranged, a liquid crystal material sandwiched between the substrates, driving means for driving a pixel group arrayed on each of selected scanning lines with the same polarity, and polarity reversal means for compensating for flickers by reversing the polarity, wherein in a display area, a scanning line selection order is arbitrarily determined, and polarities are reversed on the basis of the determination result so as not to produce a bundle of scanning lines having the same polarity within one field.

In addition, according to the present invention, there is provided a driving method for a liquid crystal display device including a pair of substrates, on at least one of which A pixels or scanning lines and switching elements for selecting the pixels or the scanning lines are arranged, and a liquid crystal material sandwiched between the substrates, wherein a display area is divided into n sub-fields for sequentially displaying one frame image along a time axis, each of the sub-fields is basically constituted by $A \div n \times m$ (where A is a positive integer, n is a positive integer ranging from 3 to A, and m is a positive integer equal to or smaller than n) pixels or scanning lines, and the pixels or the scanning lines are selected at predetermined intervals in each of the sub-fields, comprising driving a pixel group arrayed on each of selected scanning lines with the same polarity, compensating for flickers by reversing the polarity, and selecting the pixels or the scanning lines in each of the sub-fields at predetermined intervals.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention and, together with the general description given above and the detailed description of the preferred embodiments given below, serve to explain the principles of the invention.

DETAILED DESCRIPTION OF THE PREFERRED EMBODIMENTS

Figure 1:
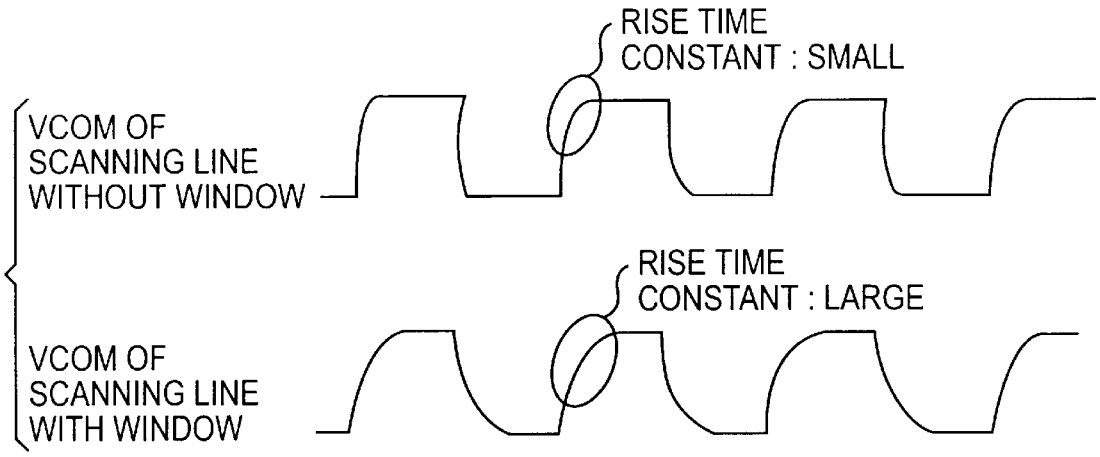
FIG. 1 PRIOR ART
FIG. 1 is a view showing the waveforms of signals at the respective portions in a window display operation based on a conventional driving method.

A liquid crystal display device and a driving method therefor according to the first aspect of the present invention are characterized in that when an image is to be displayed by A pixels or scanning lines for which selection switching elements are provided, the scanning line selection order is arbitrarily determined, and the polarities are reversed on the basis of the determination result so as not to form a bundle of scanning lines having the same polarity within each field. In this case, after polarity reversal is detected, the scanning line selection order may be determined on the basis of the detection result.

For example, one frame image is divided into n sub-fields for sequentially displaying the image along the time axis, and each of the sub-fields is basically constituted by $A \div n \times m$ (where A is a positive integer, n is a positive integer equal to or larger than 3 and equal to or smaller than A, and m is equal to or smaller than n) pixels or scanning lines of the plurality of pixels or scanning lines.

In this arrangement, in order to improve image quality, the polarity of a scanning line for which a write operation is to be performed is made different from the polarities of the adjacent scanning lines as much as possible, thereby minimizing the number of adjacent scanning lines having the same polarity.

In addition, when an image is to be displayed by scanning lines, an image signal for one frame image is subjected to n:m interlaced processing, and the switching elements are selected and driven in accordance with the resultant image signal. According to this driving method, i.e., the multi-field driving method, since the number of times scanning lines are selected is decreased, a reduction in power consumption can be attained. In addition, this selection method can compensate for flicker components (e.g., plane flickers) produced by polarity reversal.

According to the present invention having the above arrangement, i.e., using both the H inversion driving method and the multi-field driving method, when the effective voltages applied to pixels vary depending on image signals owing to a blunt leading edge of the voltage applied to the common electrode, the polarity of the common electrode is reversed before a scanning line selection interval. With this operation, since a write operation is performed in a state in which the voltage to the common electrode has completely risen, the voltage distribution at the common electrode which depends on the image signal can always be made uniform within the frame. As a result, picture degradation due to crosstalk can be greatly reduced. Also, since the ON time of the gate lines can be extended in synchronism with the polarity reversal cycle to prolong the write time into pixels, the writing characteristics in the pixel electrodes can be improved.

When the H inversion driving method and the multi-field driving method are used at once, the polarity reversal cycle coincides with the scanning line selection cycle, and an image is displayed with a plurality of adjacent scanning lines having the same polarity. As a result, horizontal streaks may be displayed. Since this group of adjacent scanning lines having the same polarity changes its position along the time axis, this group does not stand still but moves. For this reason, if the group falls within the range in which it can be visually recognized according to the visual temporal-spatial frequency characteristics, the image quality is greatly degraded.

In addition, the flicker components of a high-resolution image having no correlation may not be compensated for, and aliasing noise may be caused by the differences between the flicker components. This aliasing noise is not still but dynamic. If, therefore, this aliasing noise falls within the range in which it can be visually recognized according to the visual temporal-spatial frequency characteristics, the image quality is greatly degraded.

In the multi-field driving method, since the holding interval is greatly prolonged, flicker components per each scanning line increase. For this reason, line interference occurring in each sub-field is visually recognized, resulting in degradation in the image quality of a still picture.

In order to prevent picture degradation caused by line interference, horizontal streaking interference, and aliasing noise caused by such interference, the following means are used to make such interference and noise fall within the range in which they cannot be visually recognized according to the visual temporal-spatial frequency characteristics.

According to the first means of the first aspect of the present invention, the intervals between pixels or scanning lines selected in the respective sub-fields are made different from each other, and the polarity reversal cycle is made different from the pixel/scanning line selection/non-selection cycle.

According to the second means of the first aspect, different polarity reversal cycles are set in the respective sub-fields in the first means.

According to the third means of the first aspect, a display operation is performed while the interval of the pixels or scanning lines selected in each sub-field is changed in accordance with the polarity reversal cycle. That is, the pixel/scanning line selection/non-selection cycle is made different from the polarity reversal cycle. Note that the intervals between pixels or scanning lines selected in the respective sub-fields may be made equal to each other.

According to the fourth means of the first aspect, the intervals between pixels or scanning lines selected in the respective sub-fields are made different from the polarity reversal cycle and also made different from each other. Note that the polarity reversal cycles in the respective sub-fields may be made equal to each other.

According to the first means, a scanning order which tends to cause picture degradation may be set depending on the cycle of polarity reversal for compensating for flickers. Even in this case, the polarity reversal cycle can be selectively changed to greatly reduce picture degradation.

According to the first and third means, no group of spatially adjacent scanning lines is produced having the same polarity, or such a group does not fall within the range in which it can be visually recognized according to special temporal flicker frequency of human vision, or is made difficult to visually recognize. According to the first and third means, when an image signal is subjected to n:m interlaced processing to display an image with scanning lines, the number of adjacent scanning lines having the same polarity in one frame can be set to be n or less. Therefore, flickers (luminance differences) owing to write polarity do not have any spatial periodicity within the panel surface, or the spatial frequency becomes high within the panel surface. For this reason, a single-polarity group (horizontal streak), which is caused, for example, when the polarity reversal cycle coincides with the switching element selection cycle in multi-field driving, does not fall within the range in which it can be visually recognized according to special temporal flicker frequency of human vision, or is made difficult to visually recognize, thereby greatly reducing the picture degradation.

In displaying a high-resolution image having no correlation, flickers due to write polarity are produced as new carriers on the spatial frequency axis, resulting in aliasing noise. In this case, this aliasing noise has no spatial periodicity, or the spatial frequency becomes high within the panel surface. For this reason, the aliasing noise does not fall within the range in which it can be visually recognized according to special temporal flicker frequency of human vision, or is made difficult to visually recognize, thereby greatly reducing the picture degradation.

According to third means, a polarity reversal cycle which tends to cause picture degradation may be set depending on the scanning line selection/non-selection cycle. Even in this case, since the scanning line selection order can be selectively changed, the picture degradation can be greatly reduced.

According to the second and fourth means, if flickers cannot be compensated for by a given method, flickers can be made difficult to visually recognize by changing the polarity reversal cycle and the scanning line selection/non-selection cycle throughout a plurality of sub-fields. In addition, this one method can be used together with the second and fourth means. Flickers caused by polarity reversal can be compensated for by using a common voltage. However, flicker compensation may be performed more effectively by changing the common voltage in accordance with the polarity reversal cycle.

According to the second and fourth means, by setting different scanning order s or polarity reversal cycles in the respective sub-fields, flickers and horizontal streaking, which may be produced in a given method, can be made impossible or difficult to visually recognize according to special temporal flicker frequency of human vision.

According to the second aspect of the present invention, there is provided a driving method for a display device for displaying an image with A pixels or scanning lines for which selection switching elements are provided, basically comprising dividing one frame image into n sub-fields for sequentially displaying the image along the time axis, forming each of the sub-fields by using $A \div n \times m$ (where A is a positive integer, n is a positive integer ranging from 3 to A, and m is a positive integer equal to or smaller than n) pixels or scanning lines selected from the pixels or scanning lines, and switching a plurality of display colors throughout the continuous sub-fields, thereby displaying a predetermined halftone.

In order to improve the image quality, the display color of a pixel or scanning line used for a write operation is made different from the display color of adjacent pixels or scanning lines as much as possible, and the number of adjacent pixels or scanning lines of the same display color is preferably minimized.

When an image is to be displayed with scanning lines, n:m interlaced processing of an image signal for one frame image is performed, and the switching elements can be selectively driven in accordance with the resultant image signal.

The first means of the second aspect is characterized in that the intervals between pixels or scanning lines selected in the respective sub-fields are made different from each other (different pixel/scanning line selection orders are set). In this case, the display color switching cycle can be made equal to the pixel/scanning line selection/non-selection cycle.

The second means of the second aspect is characterized in that the display color switching cycle can be made different from the pixel/scanning line selection/non-selection cycle. In this case, the intervals of pixels or scanning lines selected in the respective sub-fields can be made equal to each other.

The third means of the second aspect is characterized in that the interval of the pixels or scanning lines selected in each sub-field is selectively changed in accordance with the image signal input to the device. For example, the interval of the pixels or scanning lines selected is changed depending on whether the halftone is to be displayed or not.

In order to compensate for screen luminance irregularity caused when different scanning line selection orders are set, the value of m/n and the scanning line selection order may be changed between the preceding sub-field and the succeeding sub-field.

In order to compensate for changes in screen luminance caused when the value of m/n and the scanning line selection order are changed, this device may have a function of detecting the screen luminance in the preceding sub-field and performing feedback control on the screen luminance in the succeeding sub-field.

The fourth means of the second aspect is characterized in that an input image signal can be selectively changed in accordance with the switching cycle of the display colors constituting a halftone input to the device and the number of display colors. For example, the display color switching cycle is changed in accordance with a plurality of different halftones. When a display image which does not allow a given switching method to compensate for pixels for displaying a halftone is input, the display color switching cycle is changed throughout a plurality of sub-fields or different display color switching cycles are set in the respective sub-fields.

In order to compensate for a change in screen luminance caused when the display color switching cycle is changed, this device may include a function of detecting the screen luminance in the preceding sub-field and performing feedback control on the screen luminance in the succeeding sub-field.

According to the first and second means, no group of spatially adjacent pixels or scanning lines of the same display color is produced, or such a group does not fall within the range in which it can be visually recognized according to special temporal flicker frequency of human vision, or is made difficult to visually recognize. In the first and second aspects, when, for example, an image signal is subjected to n:m interlaced processing to display an image with scanning lines, the number of adjacent scanning lines of the same color in one frame can be made variable or equal to or smaller than n. For this reason, each of the display colors constituting a halftone has no spatial periodicity within the panel surface, or the spatial frequency within the panel surface increases. Therefore, a single-display-color group (horizontal streak), which is produced when, for example, the FRC cycle coincides with the selection cycle of switching elements based on the MF driving scheme, does not fall within the range in which it can be visually recognized according to special temporal flicker frequency of human vision, or is made difficult to visually recognize. As a result, the picture degradation can be greatly reduced.

Assume that when a high-resolution image having no correlation is to be displayed, new carriers are produced on the spatial frequency axis owing to the differences between the display colors constituting a halftone, resulting in aliasing noise. In this case, since this aliasing noise has no spatial periodicity, or the spatial frequency within the panel surface increases, the aliasing noise does not fall within the range in which it can be visually recognized according to special temporal flicker frequency of human vision, or is made difficult to visually recognize. As a result, the picture degradation can be greatly reduced.

According to the third means, proper scanning methods can be applied to a display portion using FRC and a display portion not using FRC. In addition, when images obtained by different numbers of display colors constituting halftones and different display color switching cycles are to be displayed on the same panel, proper scanning methods can be performed for the respective images.

According to the fourth means, a scanning order which tends to cause picture degradation may be set depending on the number of display colors constituting a halftone or the display color switching cycle. Even in this case, since the display color switching cycle can be changed, the picture degradation can be greatly reduced.

In the third and fourth means, flickers which can be produced by a given method can be made impossible or difficult to visually recognize according to special temporal flicker frequency of human vision by setting different scanning orders or display color switching cycles in the respective sub-fields.

In addition, changes in screen luminance caused when the scanning methods or display color switching cycles are switched can be compensated for by detecting the screen luminance in the preceding sub-field upon a switching operation and performing feedback control on the screen luminance in the succeeding sub-field.

In the liquid crystal display device of the present invention, the type of material for the substrates and the type of liquid crystal material are not specifically limited.

The embodiments of the present invention will be described in detail below with reference to the accompanying drawings.

(First Embodiment)

A multi-field driving method is applied to each embodiment described below. In the multi-field driving method, the driving frequency is decreased by dividing one frame (a one-frame image) into a plurality of sub-fields. Since the multi-field driving method is disclosed in Jpn. Pat. Appln. KOKAI Publication No. 3-271795, a detailed description thereof will be omitted.

In the first embodiment, the intervals between pixels or scanning lines selected in the respective sub-fields are set to be equal, and the polarity reversal cycle is made different from the selection or non-selection cycle of pixels or scanning lines.

Figure 2:
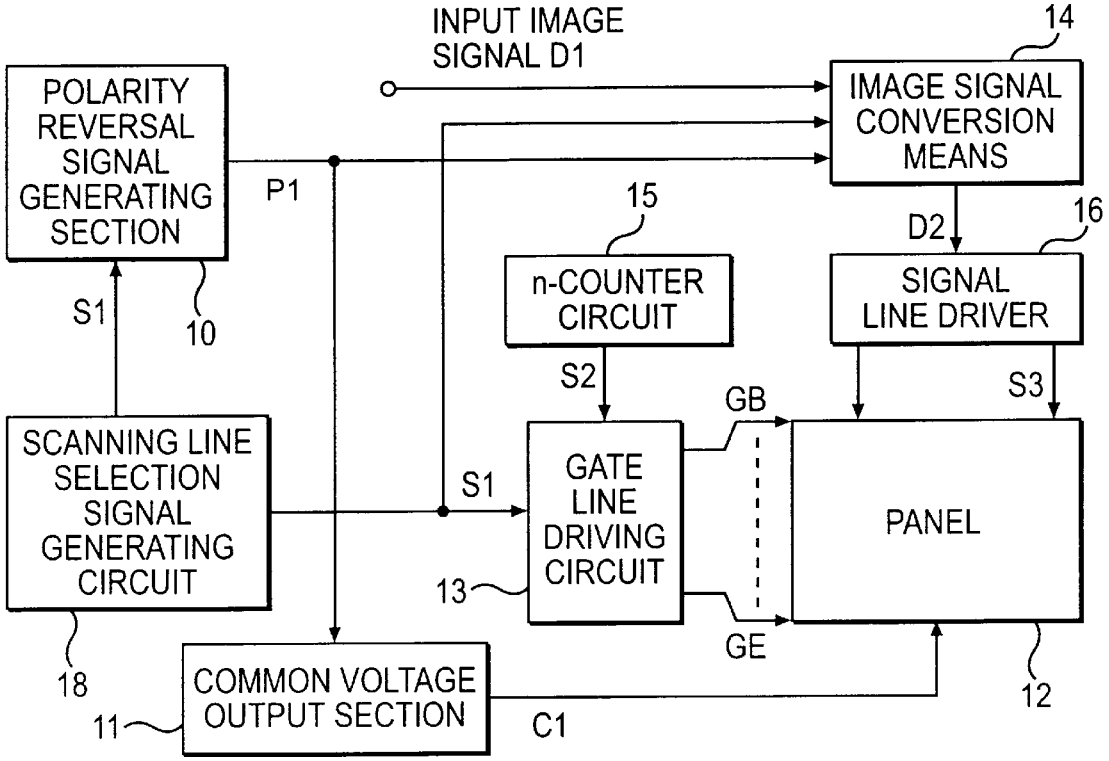
FIG. 2 is a block diagram showing the arrangement of the main part of a liquid crystal display device of the present invention.
Figure 3:
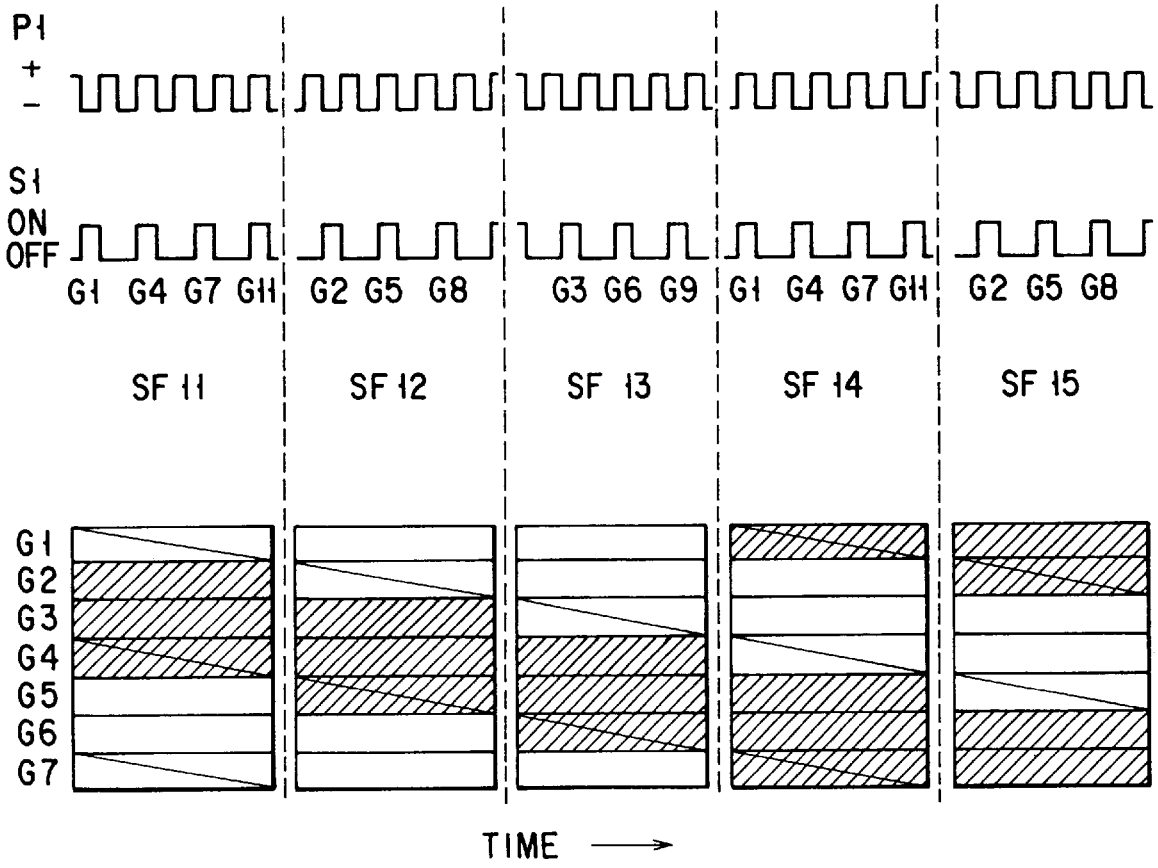
FIG. 3 is a view showing the signal waveforms and the polarity distribution obtained when a 3:1 multi-field driving method is used as a conventional polarity reversal.

FIG. 2 is a block diagram showing the arrangement of the main part of a liquid crystal display device of the present invention. FIG. 3 shows an input image signal and a polarity reversal signal in the case of the use of the conventional multi-field driving method and the conventional H reversal (polarity reversal) method with n=3 and m=1 (the number of sub-fields is 3÷1=3). The liquid crystal display device of this embodiment is mainly constituted by a polarity reversal signal generating section 10, a common voltage output section 11, a liquid crystal display panel 12, a gate line driving circuit 13, an image signal conversion means (n:m interlaced processing circuit) 14, an n-counter circuit 15, a signal line driver 16, and a scanning line selection signal generating circuit 18. Note that the liquid crystal display panel 12 is constituted by a pair of substrates, on at least one of which pixels or scanning lines and switching elements for selecting pixels or scanning lines are mounted, and a liquid crystal material sandwiched between the substrates.

In the liquid crystal display device having the above arrangement, as shown in FIG. 3, every third scanning line is selected by a scanning line selection signal S1 in a given sub-field, and the scanning lines immediately below the selected scanning lines are sequentially selected in the same manner in the next sub-field. Referring to FIG. 3, the portions with the diagonal lines indicate the scanning lines selected in the respective sub-fields. In this case, each non-selected scanning line without a diagonal line maintains the polarity set when each scanning line is selected last. The hatched portions indicate positive polarity, and the plain portions indicate negative polarity.

According to the driving method of the first embodiment, in order to change the polarity reversal cycle in accordance with the scanning line selection order, a scanning line selection signal S1 is input from the scanning line selection signal generating circuit 18 to the polarity reversal signal generating section 10 and the gate line driving circuit 13. At this time, the n-counter circuit 15 outputs a start pulse to the gate line driver for each field. More specifically, a count signal S2 is input from the n-counter circuit 15 to the gate line driving circuit 13. The gate lines of the scanning lines of the switching elements are driven by the scanning line selection signal S1 and the count signal S2.

A reversal signal P1 indicating the polarity reversal cycle is input from the polarity reversal signal generating section 10 to the image signal conversion means 14 and the common voltage output section 11. The polarity of the reversal signal P1 is reversed in units of scanning lines and fields to compensate for flickers. The input reversal signal P1 is processed by the image signal conversion means 14. The resultant signal is input to the signal line driver 16. The signal line driver 16 reverses the polarities of the signal lines of the liquid crystal display panel 12 on the basis of the input signal. In addition, the input reversal signal P1 serves to reverse the polarity of the common electrode of the liquid crystal display panel 12 through the common voltage output section 11.

The following effects can be obtained by this driving method.

(1) In general, in the H reversal driving operation, since polarity reversal must be performed in units of scanning lines at a high frequency, the driver must be designed such that a sufficient current flows at the moment of polarity reversal. Conventionally, a driver having a large current gain in one direction, e.g., a driver designed to allow a current to easily flow from the positive side to the negative side, is used such that the driver is temporarily shifted to a high potential when polarity reversal is to be performed, and a driving operation is then performed. With the combination of the H reversal driving method and the multi-field driving method, this operation need not be performed, or a large current need not be flowed at the time of polarity reversal. For this reason, the write timing can be slowed down, and hence a high-speed driver need not be used.

(2) In the H reversal driving operation, the polarity of the driver remains the same with respect to all the signal lines. For this reason, since the polarity of a signal (correction signal) supplied from D0 remains the same in each operation, the effect corresponding to one of the polarities (positive or negative) is enhanced. For example, the holding characteristic of a negative write operation is generally worse than that of a positive write operation. If, therefore, the correction signal is set on the negative side, the holding characteristic of a negative write operation can be improved. In this case, although the holding characteristic of a positive write operation may deteriorate, the image quality can be improved by making the holding characteristics of both positive and negative write operations uniform.

(3) A phenomenon called punch-through is one of the causes of picture degradation. According to this phenomenon, when the gate voltage decreases upon switching-off of a TFT (Thin Film Transistor), the pixel potential varies due to coupling caused by the parasitic capacitance.

This variation amount varies on the right and left sides of the screen because the waveform of the gate signal is blunt differently on the right and left sides of the screen (the waveform is sharp near the gate driver but becomes blunt with distance therefrom (toward the right side of the waveform)). This problem can therefore be solved by making the magnitude of D0 have a gradient in the horizontal direction.

(4) The switching characteristics of a TFT are determined by the ON and OFF gate voltages. In the signal line reversal driving operation, since the polarities of adjacent pixels are different from each other, the ON and OFF voltages cannot be determined in accordance with the polarities of the respective pixels. This operation can be performed in the H reversal driving operation. However, since the reversal driving cycle is generally short, if the voltage is shifted in this cycle, the power is wasted.

With the combination of the H reversal driving method and the multi-field driving method, the reversal driving cycle is prolonged four times that in the H reversal driving operation so that the ON and OFF voltages can be properly determined in accordance with the polarities of the respective pixels. The image quality can therefore be improved.

When scanning lines selection and polarity reversal are to be performed as shown in FIG. 3, scanning is line sequentially performed throughout three sub-fields. For this reason, the preceding and succeeding scanning lines have the same polarity. If, therefore, one field consists of three sub-fields SF11 to SF13, a group of three adjacent scanning lines having the same polarity moves. That is, so-called horizontal streaking occurs, resulting in picture degradation.

A display operation performed by changing the polarity reversal signal P1 in accordance with a scanning line selection signal will be described next.

In this embodiment, the polarity reversal signal P1 is formed by the polarity reversal signal generating section 10 in accordance with the signal S1 supplied from the scanning line selection signal generating circuit 18. In the image signal conversion means 14, output control of selected image information and non-selected image information is performed in accordance with the signal S1, and conversion of the image information is performed in accordance with the signal P1. Note that the contents of processing performed by the image signal conversion means 14 are not specifically limited, but the circuit 14 performs processing for a reduction in display image degradation.

Figure 4:
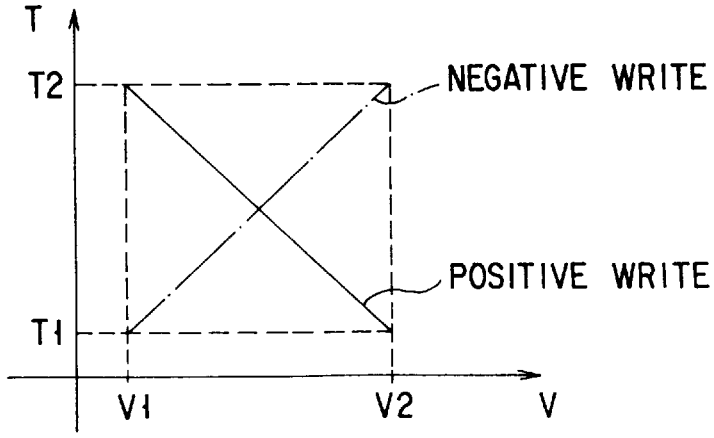
FIG. 4 is a graph showing the voltage-transmittance curves of a liquid crystal.

In addition, no specific limitations are imposed on conversion of image information. However, when, for example, the signal voltage is to be determined in accordance with reversal of the common voltage, conversion is performed such that different signal levels are set in the positive and negative write operations even at the same gradation level. When, for example, a liquid crystal cell exhibiting a voltage-transmittance curve like the one shown in FIG. 4 is used, the cell exhibits a transmittance T1 in a positive write operation with respect to a signal voltage V2, and the transmittance T1 in a negative write operation with respect to a signal voltage V1.

In this embodiment, digital signals are used as image signals, and digital/analog conversion (to be referred to as D/A conversion hereinafter) is performed in the signal line driver 16. Image signals corresponding to V1 and V2 (to be referred to as image signals DV1 and DV2) are defined as DV1=DV2, and the input image signal and the polarity reversal signal are output in one-to-one correspondence.

Figure 5A:
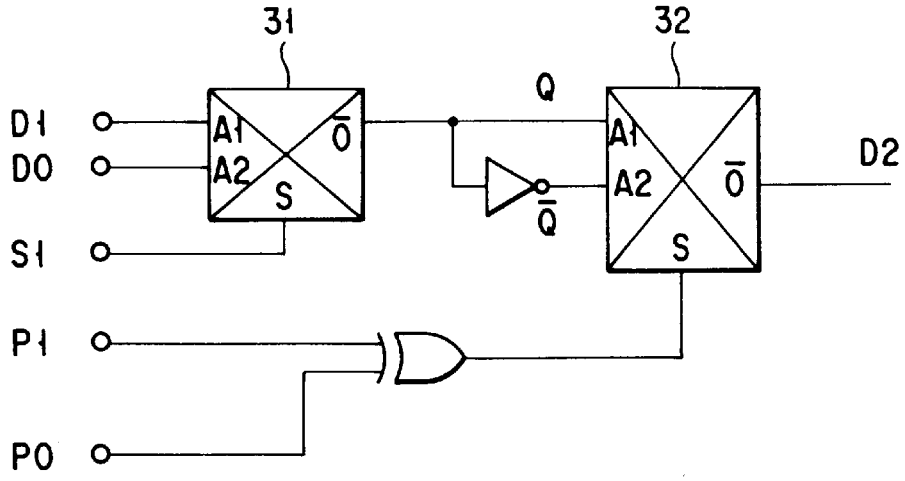
FIG. 5A is a circuit diagram for explaining the contents of processing performed by an image signal conversion means.
Figure 5B:
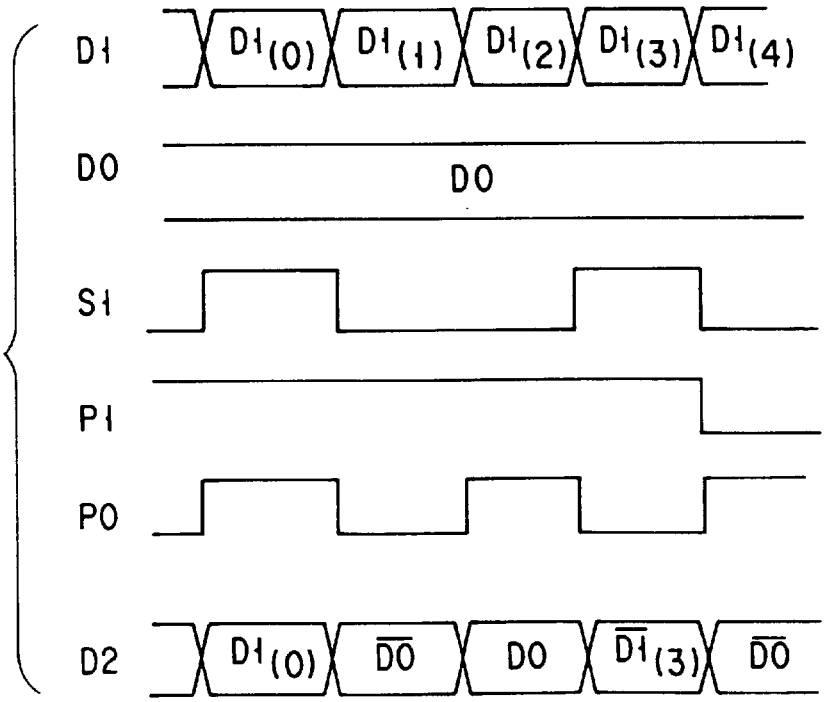
FIG. 5B is a timing chart showing the waveforms of signals at the respective portions.

In this case, the polarity reversal method must be changed, and the input image signal must be converted (the NOT is calculated in this case). For example, the exclusive OR between the polarity reversal signal (P0) and the polarity reversal signal (P1) processed to reduce display image degradation is calculated. In the logic-1 state, the NOT of the image signal is calculated, and the resultant signal is output to the signal line driver 16. FIG. 5A shows the contents of processing performed by the image signal conversion means 14. FIG. 5B shows the waveforms of signals at the respective portions. The contents of the processing shown in FIG. 5A are not specifically limited. However, for example, this device includes selectors 31 and 32. The selector 31 selects the image signal D1 or D0 in accordance with a scanning line selection signal, and the selector 32 selects the image signal reversal output upon exclusive OR between the signals P0 and P1.

In this case, the signal D0 is not written in practice, but is required to perform correction by applying a given voltage to a signal line. Any signal may be used as the signal D0. However, as the signal D0, a signal which allows an improvement in image quality through the coupling (capacitance) between the signal and the pixel is preferably used. Therefore, the signals D0 and D1 may be identical signals.

The above description is associated with the case in which the write polarity and reversal of the image signal coincide with each other. However, with the use of a reference section for comparing each signal voltage value with image signal information, conversion to a proper image signal may be performed for each polarity.

According to the present invention, with the combination of the two methods, i.e., the polarity reversal method and the scanning line selection method, the number of adjacent scanning lines having the same polarity can be minimized, or horizontal streaking which is the movement of a group of scanning lines having the same polarity can be made difficult to visually recognize.

Figure 6:
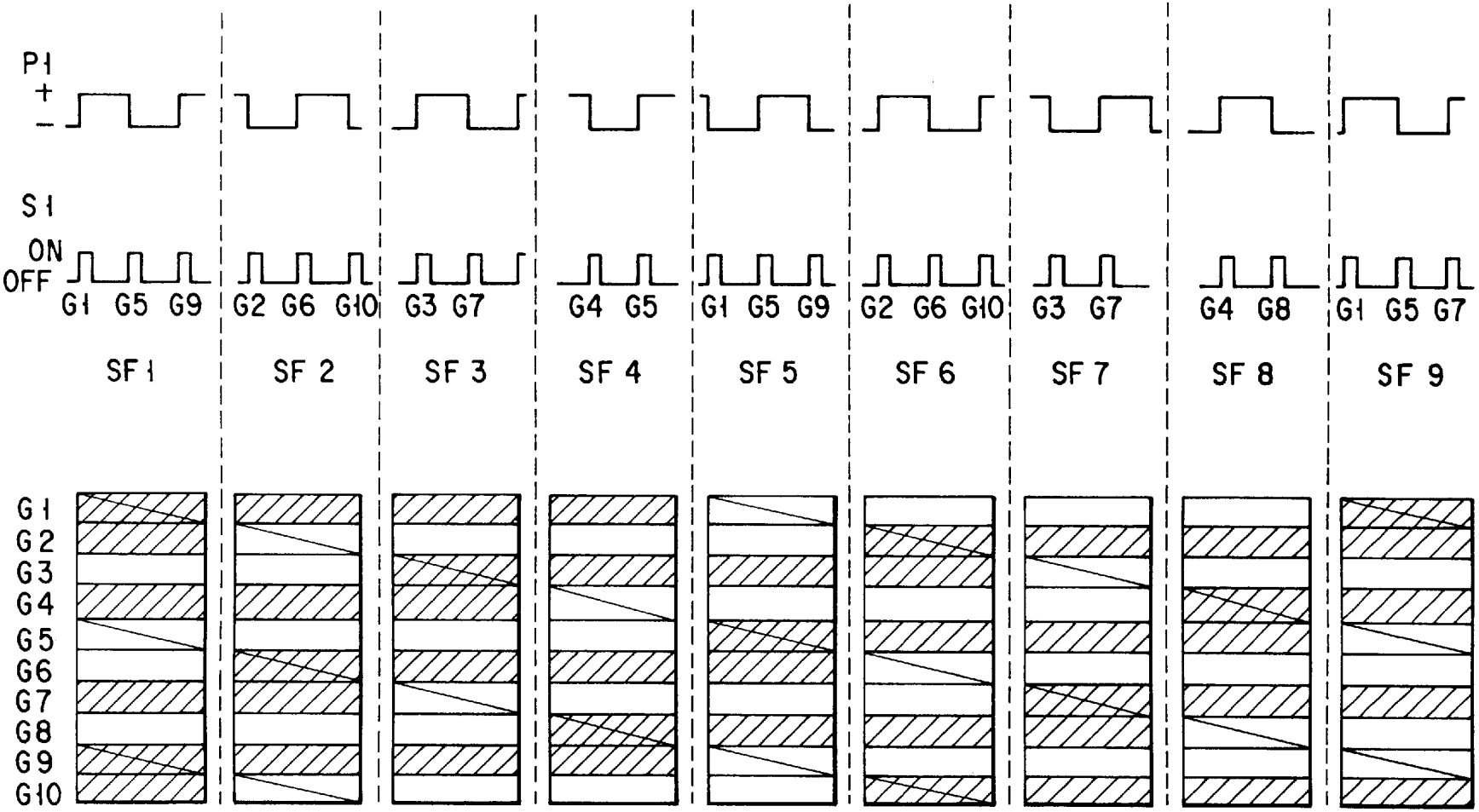
FIG. 6 is a view showing the signal waveforms in 4:1 multi-field driving and the polarity distribution obtained when the driving method of the present invention is used.

FIG. 6 shows the signals associated with the driving method of the present invention, and the image displayed on the liquid crystal panel on the basis of the signals. Referring to FIG. 6, the hatched portions indicate positive polarity, and the plain portions indicate negative polarity. The portions with the diagonal lines indicate the scanning lines selected in the respective sub-fields. In this case, each non-selected scanning line without a diagonal line maintains the polarity set when each scanning line is selected last.

In this case, a multi-field driving operation is performed with n=4 and m=1 (the number of sub-fields is 4÷1=4). The driving frequency can be decreased, and the power consumed by the signal line driver 16, the gate line driving circuit 13, the liquid crystal display panel 12, and the common voltage output section 11 can be reduced. In addition, the polarity reversal cycle is set such that the polarity of every fourth scanning line is reversed. A write operation is performed such that each selected scanning line in the next sub-field, which is located immediately below the corresponding scanning line in the previous sub-field, has the reverse polarity to that of the scanning line immediately above the selected scanning line to minimize the number of adjacent scanning lines having the same polarity. With this operation, even with the use of the multi-field driving method, the number of adjacent scanning lines having the same polarity can be set to be two or less, and the spatial frequency can be further increased.

When the multi-field driving method is to be used, since compensation must be performed between scanning lines, it is important to consider unbalanced groupings of scanning lines having the same polarities. In this embodiment, for example, compensation for every four scanning lines poses a problem. Referring to FIG. 6, unbalanced groupings of scanning lines having the same polarities are present at a rate of 3:1. However, such groups of scanning lines in a given sub-field move by three pixels in the next sub-field. That is, the speed of the horizontal streaking triples, making it difficult to visually recognize the flow. This driving method is especially effective for 2n:1 ($n \geqq 2$) multi-field driving, but is not limited to the above embodiment.

Figure 7:
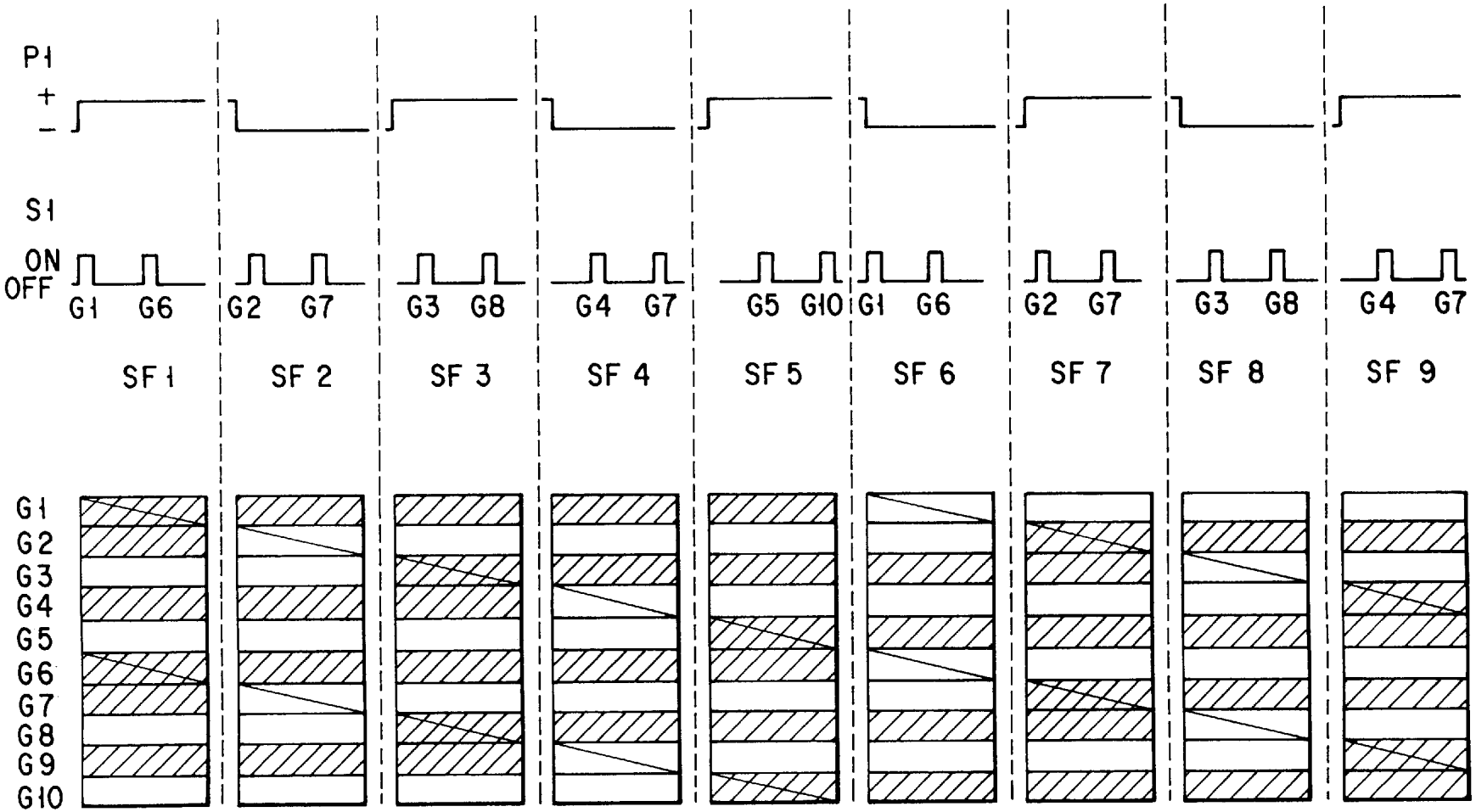
FIG. 7 is a view showing the signal waveforms in 5:1 multi-field driving and the polarity distribution obtained when the driving method of the present invention is used.

FIG. 7 shows a modification of the polarity reversal cycle in FIG. 6. Similar to FIG. 6, FIG. 7 shows signals associated with the driving method of the present invention, and the image displayed on the liquid crystal panel on the basis of the signals. In this case, the selected scanning lines in each sub-field have the same polarity, and the polarity of each selected scanning line is reversed only in units of sub-fields. Referring to FIG. 7, the hatched portions indicate positive polarity, and the plain portions indicate negative polarity. The portions with the diagonal lines indicate the scanning lines selected in the respective sub-fields. In addition, each non-selected scanning line without a diagonal line maintains the polarity set when each scanning line is selected last.

In this case, multi-field driving is performed with n=5 and m=1 (the number of sub-fields is 5). In this case as well, the driving frequency can be decreased, the power consumed by the signal line driver 16, the gate line driving circuit 13, the liquid crystal display panel 12, and the common voltage output section 11 can be reduced. In addition, in each sub-field, since the common voltage is kept at a constant voltage (positive or negative polarity), the power consumed by the signal line driver 16, the liquid crystal display panel 12, and the common voltage output section 11 can be reduced more effectively. In this method, however, since the positive and negative write operations are performed on the entire screen, plane flickers may occur.

Figure 8A:
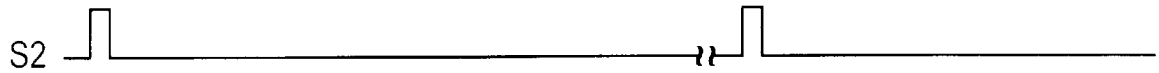
FIGS. 8AA–8AE are timing charts showing the contents of processing performed by the circuit in a double-speed driving operation based on 5:1 multi-field driving.
Figure 8A:
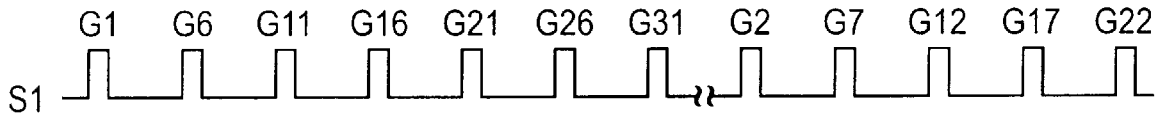
Figure 8A:
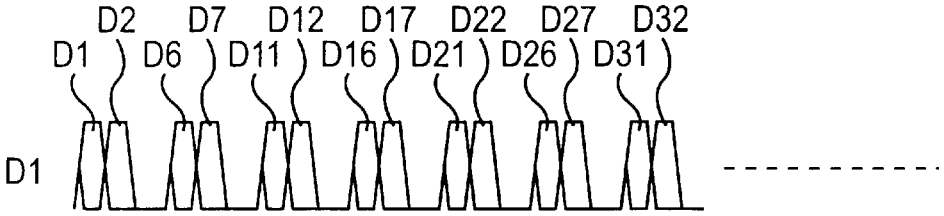
Figure 8A:
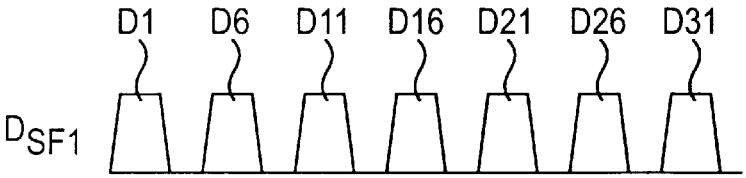
Figure 8A:
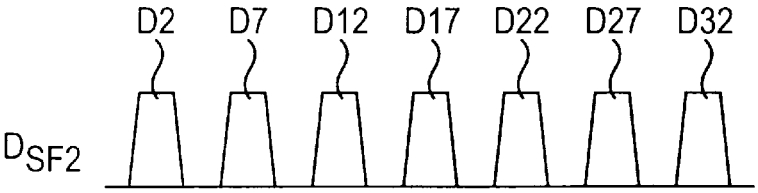
Figure 8B:
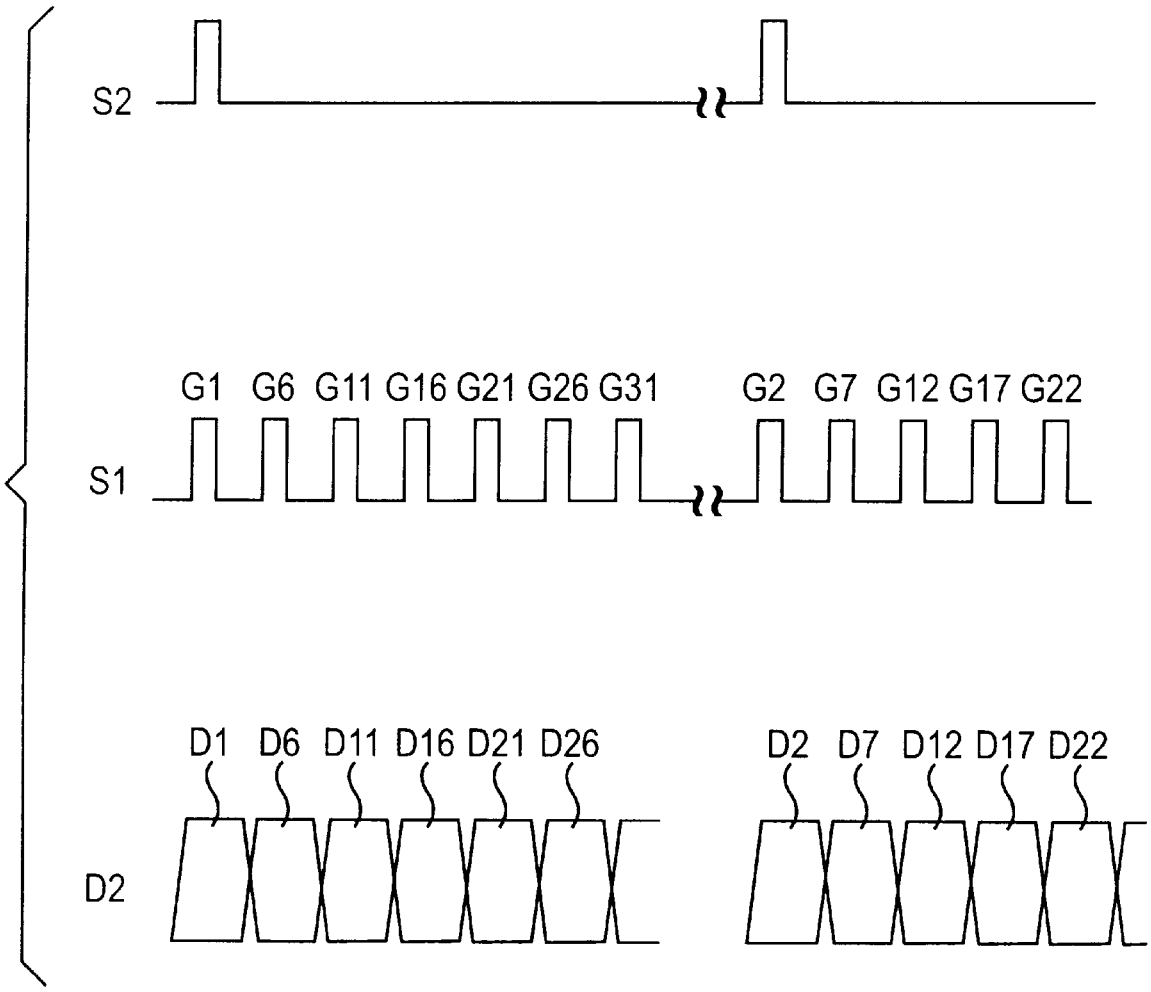

As shown in FIGS. 8AA–8AE, therefore, double-speed processing of input image information is performed; a data group in the next sub-field is recorded, while a data group in another sub-field is written during SF1. FIGS. 8AA–8AE show the signal waveforms in the case of recording a data arrangement to a memory, and FIG. 8B shows the signal waveforms in the case of the double-speed processing. For example, this write operation is performed with positive polarity. Subsequently, the data group recorded on the memory during SF2 is written with the reverse polarity to that in the above sub-field. Since this sub-field interval is ½ that in a normal multi-field driving operation, plane flickers fall within a high-frequency range, and are not visually recognized. In this case, the power consumed by the clock section of the gate line driving circuit 13 increases. However, since the power consumed by the common voltage output section 11 greatly decreases, the overall power consumption decreases.

A memory may be mounted in the image signal conversion means 14 in FIG. 2 to perform the above processing. For the sake of descriptive convenience, no specific explanation is made on the timing shifts of signals due to the buffers in the image signal conversion means 14 and the signal line driver 16. In practice, however, the timing of each signal is matched with the timing of each scanning line to obtain a desired image.

Figure 9:
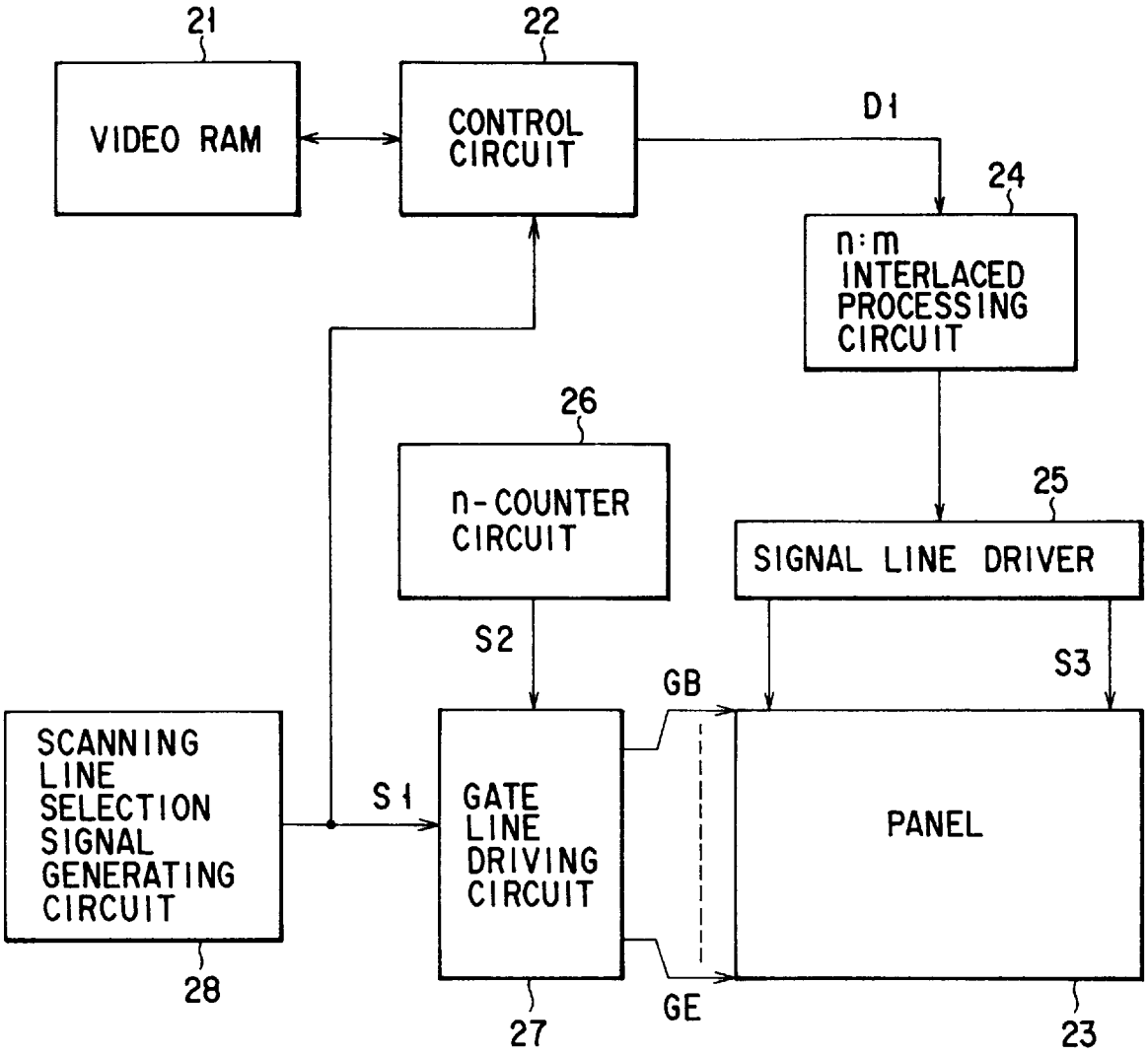
FIG. 9 is a block diagram showing an arrangement for conversion processing of an image signal in the liquid crystal display device of the present invention.

With the addition of the memory, increases in the number of ICs and power consumption are expected. However, as shown in FIG. 9, by controlling signal output processing on the computer side from which signals are output, the device can be designed such that no memory is mounted in the module. In general, in an information terminal body, signal output to the module is controlled by a video RAM 21 and a control circuit 22. In this embodiment, in order to convert an input image in accordance with the n:m interlaced processing means, the scanning line selection signal S1 for the module circuit is input from a scanning line selection signal generating circuit 28 to the control circuit 22. The control circuit 22 designates addresses and changes the image output timing with respect to the video RAM 21. Referring to FIG. 9, reference numeral 23 denotes a liquid crystal display panel; 24, an image signal conversion means; 25, a signal line driver; 26, an n-counter circuit; and 27, a gate line driving circuit. These components have the same functions as those in FIG. 2.

In this embodiment, since the reversal cycle of the common voltage can be greatly shortened, no problem is posed in terms of the leading edge of the common voltage in polarity reversal. That is, since the polarity of the common voltage may be reversed in the blanking interval, the time constant of the common voltage in a write operation can be set to be relatively large. The sheet resistance of the counter electrode can be increased, or the number of feeding points can be decreased.

The above driving method is especially effective for double-speed processing of 2n+1:1 ($n \geqq 1$) multi-field driving, but is not limited to the above embodiment.

(Second Embodiment)

In the second embodiment, the intervals between pixels or scanning lines selected in the respective sub-fields are set to be equal, and the polarity reversal cycle is made different from the selection or non-selection cycle of pixels or scanning lines. In addition, the polarity reversal cycles in the respective fields are made different from each other.

Figure 10:
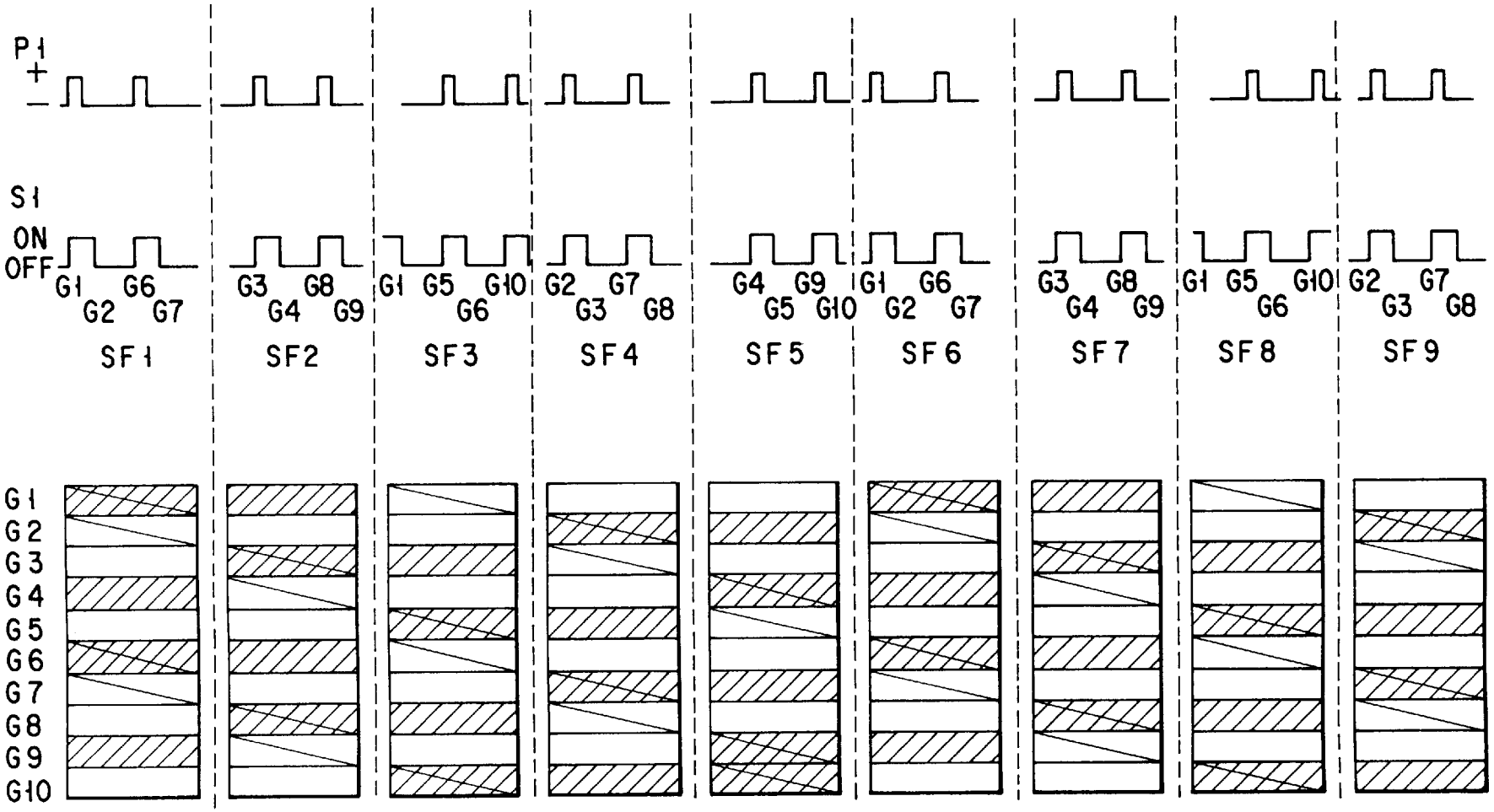
FIG. 10 is a view showing the signal waveforms in 5:2 multi-field driving and the polarity distribution obtained when a driving method according to the second embodiment of the present invention is used.

FIG. 10 shows the signals associated with another driving method of the present invention, and the image displayed on the liquid crystal display panel on the basis of the signals. Referring to FIG. 10, the hatched portions indicate positive polarity, and the plain portions indicate negative polarity. The portions with the diagonal lines indicate the scanning lines selected in the respective sub-fields. In this case, each non-selected scanning line without a diagonal line maintains the polarity set when each scanning line is selected last.

In this embodiment, multi-field driving is performed with n=5 and m=2 (although the number of sub-fields is 2.5, the display image is constituted by three sub-fields). The driving frequency can be decreased, and the power consumed by a signal line driver 16, a gate line driving circuit 13, a liquid crystal display panel 12, and a common voltage output section 11 can be reduced. In this case, every third and second scanning lines undergo polarity reversal to have the same polarity. In addition, a write operation is performed such that each selected scanning line in the next sub-field, which is located below the corresponding scanning line in the previous sub-field, has the reverse polarity to that of the scanning line immediately above the selected scanning line to minimize the number of adjacent scanning lines having the same polarity. With this operation, even with the use of the multi-field driving method, the number of adjacent scanning lines having the same polarity can be set to be two or less, and the spatial frequency can be further increased.

In this method, however, since positive and negative write operations are performed in an unbalanced manner at a rate of 3:2 within the screen, DC components may be applied to the liquid crystal material and the aligning films. For this reason, the ratios of positive write scanning lines to negative write scanning lines are switched every several sub-fields. In this case, plane flickers upon switching of the ratios may be visually recognized. However, the picture degradation can be reduced by decreasing the switching frequency to a frequency (e.g., 1 [Hz]) or less at which no flickers are visually recognized according to special temporal flicker frequency of human vision. Alternatively, the common voltage output section 11 may output an optimal common voltage in accordance with the unbalanced distribution of polarities.

Figure 11:
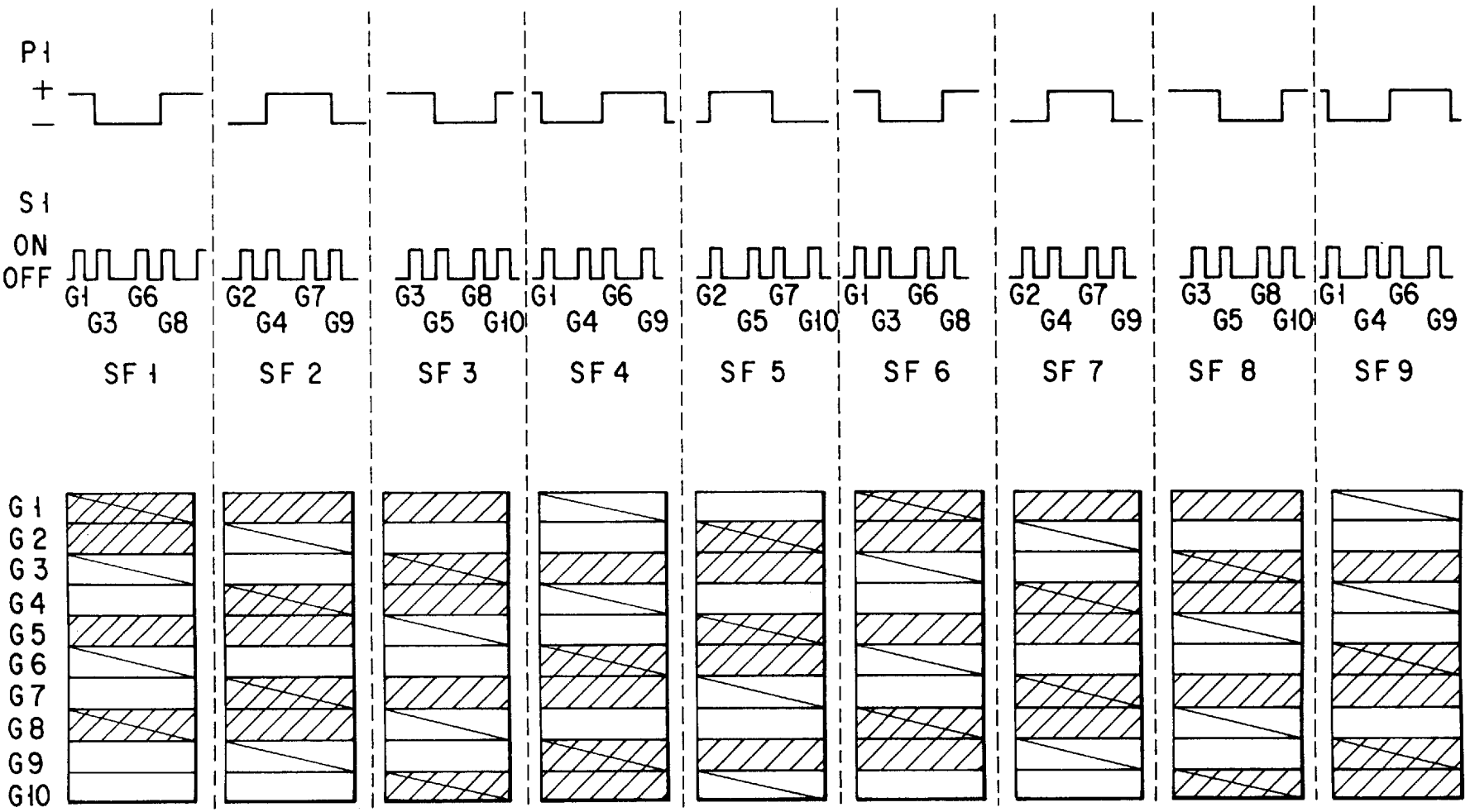
FIG. 11 is a view showing the signal waveforms and the polarity distribution obtained when a driving method according to a modification of the second embodiment of the present invention is used.

FIG. 11 shows a modification of the scanning line selection method in FIG. 10. Similar to FIG. 10, FIG. 11 shows the signals associated with the driving method of the present invention, and an image displayed on the liquid crystal display panel. In the driving method shown in FIG. 11, no two continuous scanning lines are driven in each sub-field. Referring to FIG. 11, the hatched portions indicate positive polarity, and the plain portions indicate negative polarity. The portions with the diagonal lines indicate the scanning lines selected in the respective sub-fields. In this case, each non-selected scanning line without a diagonal line maintains the polarity set when each scanning line is selected last.

In this embodiment, multi-field driving is performed with n=5 and m=2 (although the number of sub-fields is 2.5, the display image is constituted by three sub-fields). The driving frequency can be decreased, and the power consumed by the signal line driver 16, the gate line driving circuit 13, the liquid crystal display panel 12, and the common voltage output section 11 can be reduced. In this case as well, every third and second scanning lines undergo polarity reversal to have the same polarity. In addition, a write operation is performed such that each selected scanning line in the next sub-field, which is located immediately below the corresponding scanning line in the previous sub-field, has the reverse polarity to that of the scanning line immediately above the selected scanning line to minimize the number of adjacent scanning lines having the same polarity.

With this operation, even with the use of the multi-field driving method, the number of adjacent scanning lines having the same polarity can be set to be two or less, and the spatial frequency can be further increased. In addition, in this method, although positive and negative write scanning lines are present in an unbalanced state at a rate of 3:2, positive and negative polarities are averaged within the screen. For this reason, the DC components applied to the aligning films can be reduced as compared with the case shown in FIG. 10.

Similar to the case shown in FIG. 10, in this case, the ratios of positive write scanning lines to negative write scanning lines may be switched every several sub-fields. This driving method is especially effective for 2n+1:1 (n≧1) multi-field driving, but is not limited to the above embodiment.

(Third Embodiment)

In the third embodiment, the intervals between pixels or scanning lines selected in the respective sub-fields are changed with respect to the polarity reversal cycle.

Figure 12:
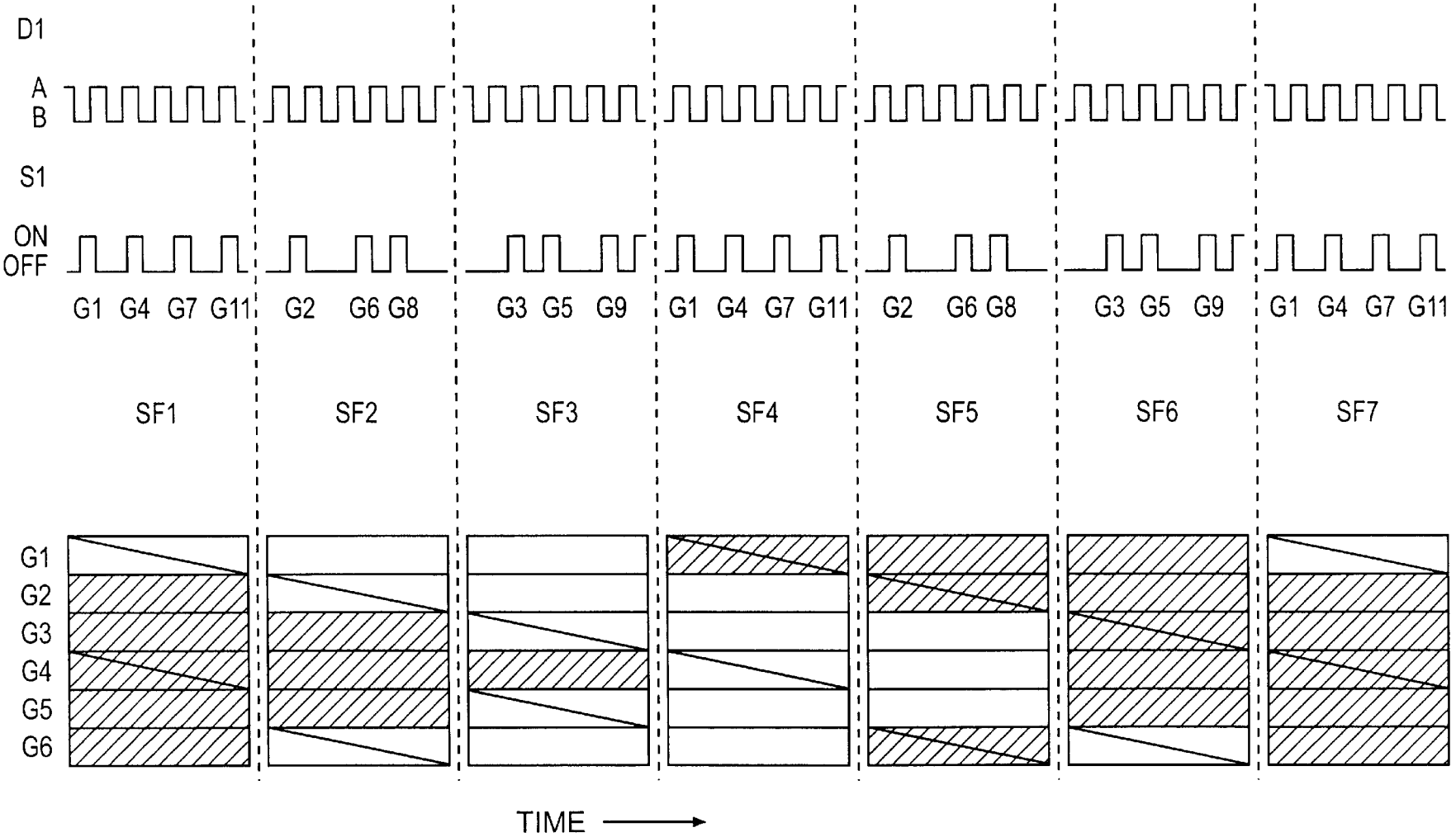
FIG. 12 is a view showing the signal waveforms and the polarity distribution obtained when a driving method according to the third embodiment of the present invention is used.

FIG. 12 shows the signals associated with still another driving method of the present invention, and the image displayed on the liquid crystal display panel on the basis of the signals. Referring to FIG. 12, the hatched portions indicate positive polarity, and the plain portions indicate negative polarity. The portions with the diagonal lines indicate the scanning lines selected in the respective sub-fields. In this case, each non-selected scanning line without a diagonal line maintains the polarity set when each scanning line is selected last.

In this case, multi-field driving is performed with n=6 and m=2 (the number of sub-fields is 3). The driving frequency can be decreased, and the power consumed by a signal line driver 16, a gate line driving circuit 13, a liquid crystal display panel 12, and a common voltage output section 11 can be reduced.

According to this method, in some sub-fields, the number of adjacent scanning lines having the same polarity is more than n. However, as shown in FIG. 12, since the width of the horizontal streak changes, and no horizontal streaking is produced, the spatial spectrum of the horizontal streak is dispersed, making it difficult to visually recognize the horizontal streak. At the same time, this method is effective for aliasing noise.

(Fourth Embodiment)

In the fourth embodiment, the intervals between pixels or scanning lines selected in the respective sub-fields are changed with respect to the polarity reversal cycle, and made different from each other in the respective sub-fields.

Figure 13:
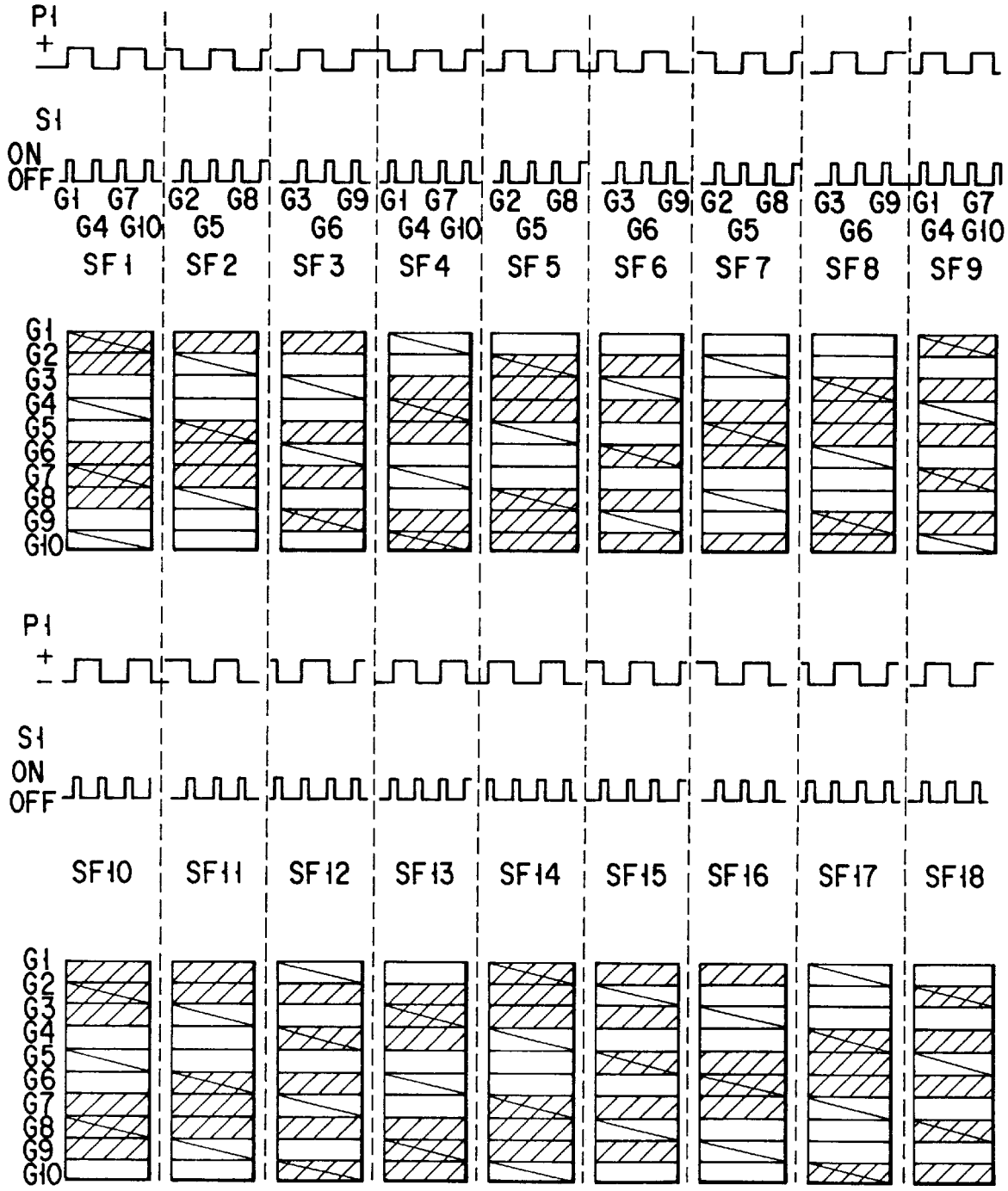
FIG. 13 is a view showing the signal waveforms and the polarity distribution obtained when a driving method according to the fourth embodiment of the present invention is used.

FIG. 13 shows the signals associated with still another driving method of the present invention, and the image displayed on the liquid crystal display panel on the basis of the signals. Referring to FIG. 13, the hatched portions indicate positive polarity, and the plain portions indicate negative polarity. The portions with the diagonal lines indicate the scanning lines selected in the respective sub-fields. In this case, each non-selected scanning line without a diagonal line maintains the polarity set when each scanning line is selected last.

In this case, multi-field driving is performed with n=3 and m=1 (the number of sub-fields is 3). The driving frequency can be decreased, and the power consumed by a signal line driver 16, a gate line driving circuit 13, a liquid crystal display panel 12, and a common voltage output section 11 can be reduced.

In this driving method, in SF1 to SF6, scanning lines are selected in the same order, and positive and negative polarities are reversed between the sub-fields. In SF7 to SF12, the selection order is changed, and the polarities are reversed between the sub-fields. Similar processing is performed in SF13 to SF18, and the scanning line selection order is partly changed. This operation makes it difficult to visually recognize a horizontal streak or horizontal streaking unlike those produced when driving is performed in a predetermined selection order.

(Fifth Embodiment)

The fifth embodiment is an application of each embodiment described above, in which the image quality is improved by changing the polarity reversal method in the holding interval.

In the multi-field driving operation, in each scanning line non-selection interval, no write operation is performed. For this reason, even if the signal line voltage and the common electrode voltage are changed, the pixel electrode is theoretically in a floating state, and the electric field applied to the liquid crystal layer is kept constant. In practice, however, a leakage current is produced owing to the switching characteristics of the TFT as a switching element and the characteristics of the liquid crystal material. As a result, the pixel electrode potential changes. In this case, the pixel potential variations and luminance changes owing to the leakage current can be suppressed by controlling the polarity reversal during the holding interval.

Figure 14:
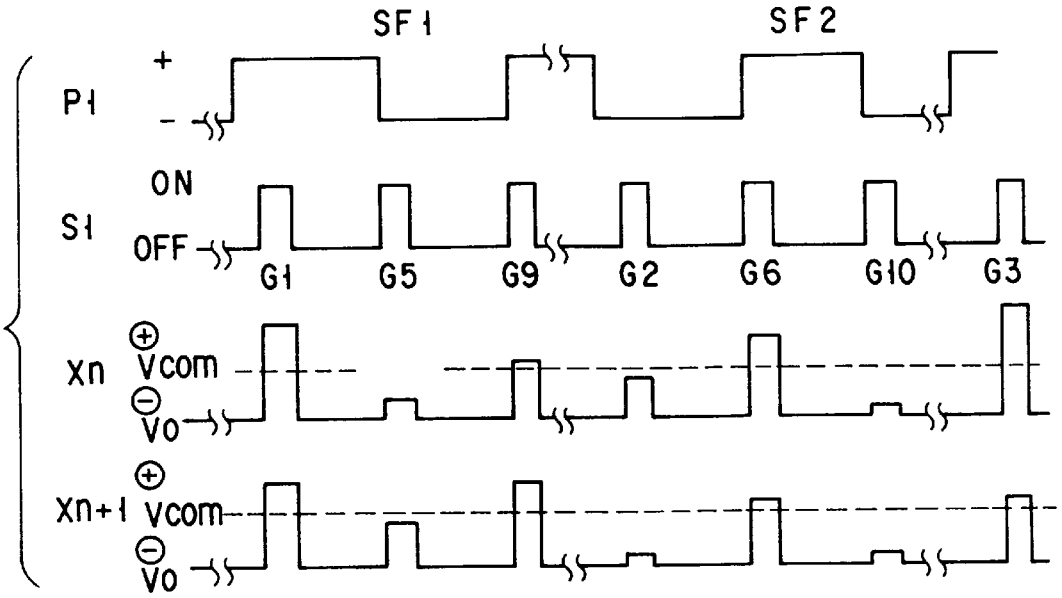
FIG. 14 is a timing chart showing the signal waveforms in the fifth embodiment.

In this case, multi-field driving is performed with n=4 and m=1 (the number of sub-fields is 4÷1=4). In general, the negative write holding characteristic exhibits a larger leakage current than the positive write holding characteristic. Therefore, for example, as shown in FIG. 14, negative write voltages are applied to signal lines. For the sake of illustrative convenience, FIG. 14 shows the voltage values applied to signal lines Xn and Xn+1 in reference to the common potential (Vcom). In this case, no specific limitations are imposed on a voltage value V0, but the voltage value V0 is preferably set to make the positive and negative write characteristics uniform.

For this processing, a scanning line selection signal S1 is input to a signal line driver 16, and V0 generated in the signal line driver 16 is output to each signal line. Note that V0 may be generated on the basis of D0. This embodiment is not limited to this case. For example, the polarity reversal cycle can be variously changed in the holding interval to improve the switching characteristics in the holding interval.

Figure 15:
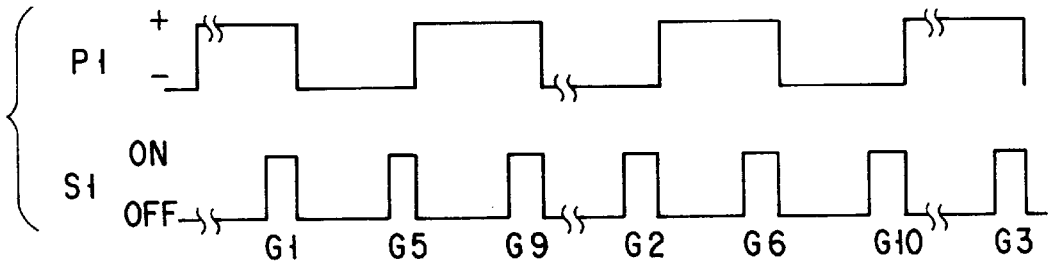
FIG. 15 is a timing chart showing the signal waveforms for compensating the leak characteristics according to a modification of the fifth embodiment.
Figure 16A:
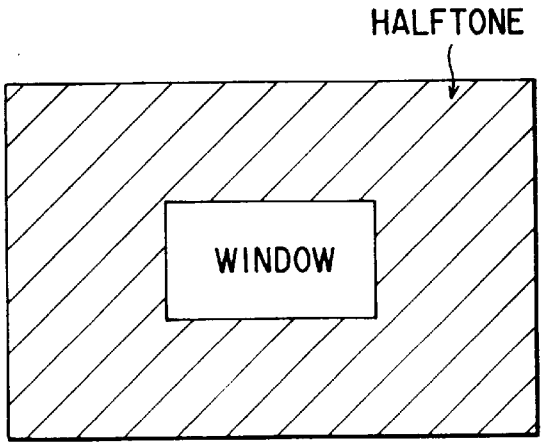
FIGS. 16A and 16B are views of a display image showing crosstalk in a window display operation.
Figure 16B:
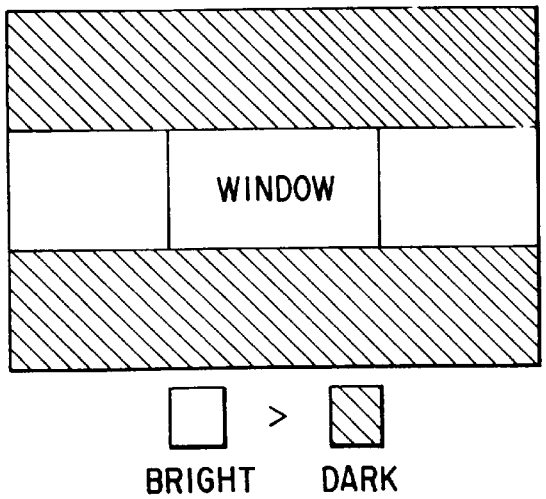

When the resistance of the common electrode is high, and the time constant is large, the waveform of the leading edge becomes blunt. In order to improve such a waveform characteristic, as shown in FIG. 15, the polarity of the common electrode is reversed to the polarity for the next write operation during the holding interval, thereby performing a write operation in a state in which the waveform of the common voltage has completely risen. Assume that window display is performed as shown in FIG. 16A. In this case, as shown in FIG. 16B, the contrast of the portions on the right and left sides of the window is different from that of the remaining portions, resulting in picture degradation due to crosstalk.

Figure 17:
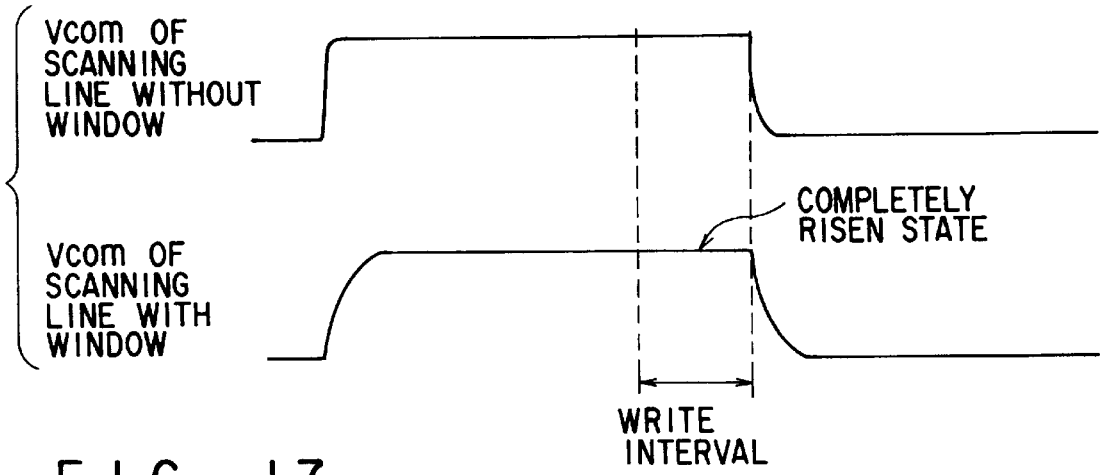
FIG. 17 is timing chart showing the waveforms of signals at the respective portions in a window display operation using a driving method of the present invention.

Assume that black is displayed in the window, and halftones are displayed outside the window. In this case, the halftones on the right and left sides of the window are brighter than those on the remaining portions. This is because, capacitive coupling between the signal lines and the common electrode makes the leading edge of the waveform of the common voltage in the scanning line selection interval without a window differ from that in a scanning line selection interval with a window, as shown in FIG. 1. For this reason, the effective voltage applied to the pixel electrodes in a write operation varies to cause crosstalk. According to this embodiment, as shown in FIG. 17, since polarity reversal of the common voltage is performed at a sufficiently earlier timing than in a normal operation, the above capacitive coupling has no influence on the leading edge of the waveform of the common voltage. Therefore, crosstalk can be prevented, and the image quality can be greatly improved.

This embodiment is not limited to 4:1 multi-field driving, and can be applied to all types of n:m multi-field driving. In this case, the driving method of this embodiment is applied to the second embodiment in which two continuous lines are written.

Figure 18B:
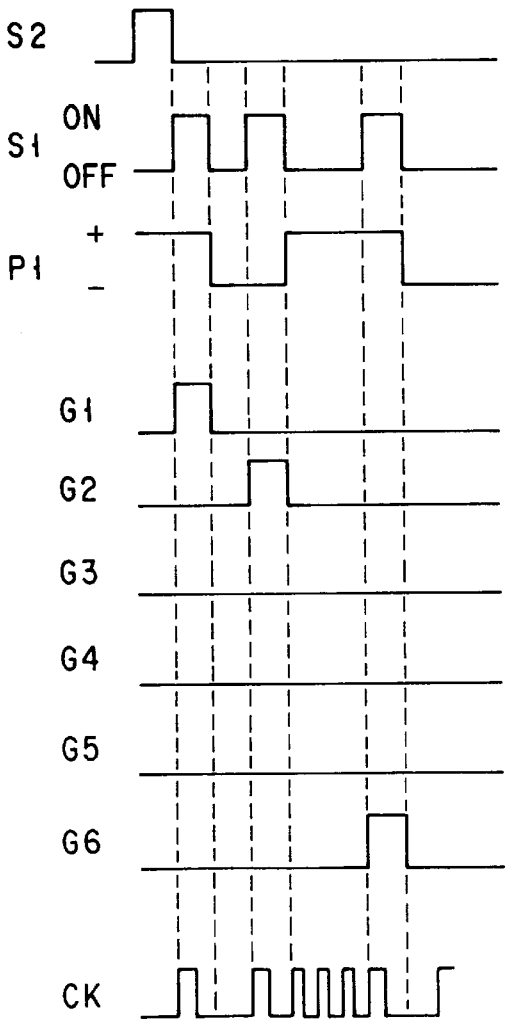
FIGS. 18A and 18B are timing charts showing a scanning line selection method and a polarity reversal method according to a modification of the fifth embodiment of the present invention.
Figure 18A:
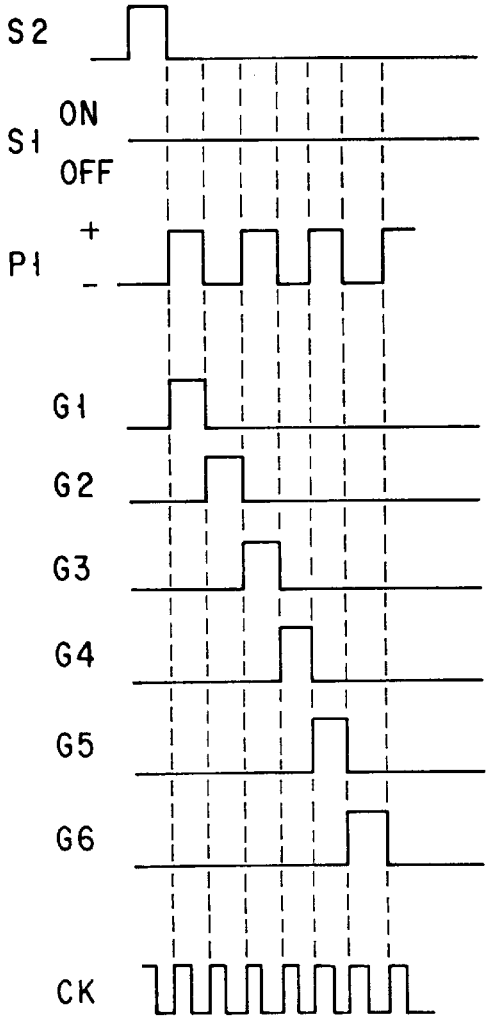

When write operations are to be continuously performed, it is taken for granted that there is no interval in which the polarity of the common electrode is reversed in advance in the next scanning line write interval (FIG. 18A). Even in this case, the above operation can be performed by setting the scanning line selection timing as shown in FIG. 18B. Assume that the gate line driving circuit has a function of changing the timing of the shift register. Referring to FIG. 18B, the timing is charged by using a clock. More specifically, when a scanning line is selected before scanning lines are continuously selected, the clock is disabled. After the common voltage sufficiently rises upon polarity reversal, the clock is enabled again to shift the signal. In addition, the scanning line selection signal is turned on to select a scanning line after continuous selection of scanning lines. Subsequently, a shift operation is performed by a clock signal faster than that in a normal operation to match the shift register timing with the next scanning line selecting operation.

Figure 19A:
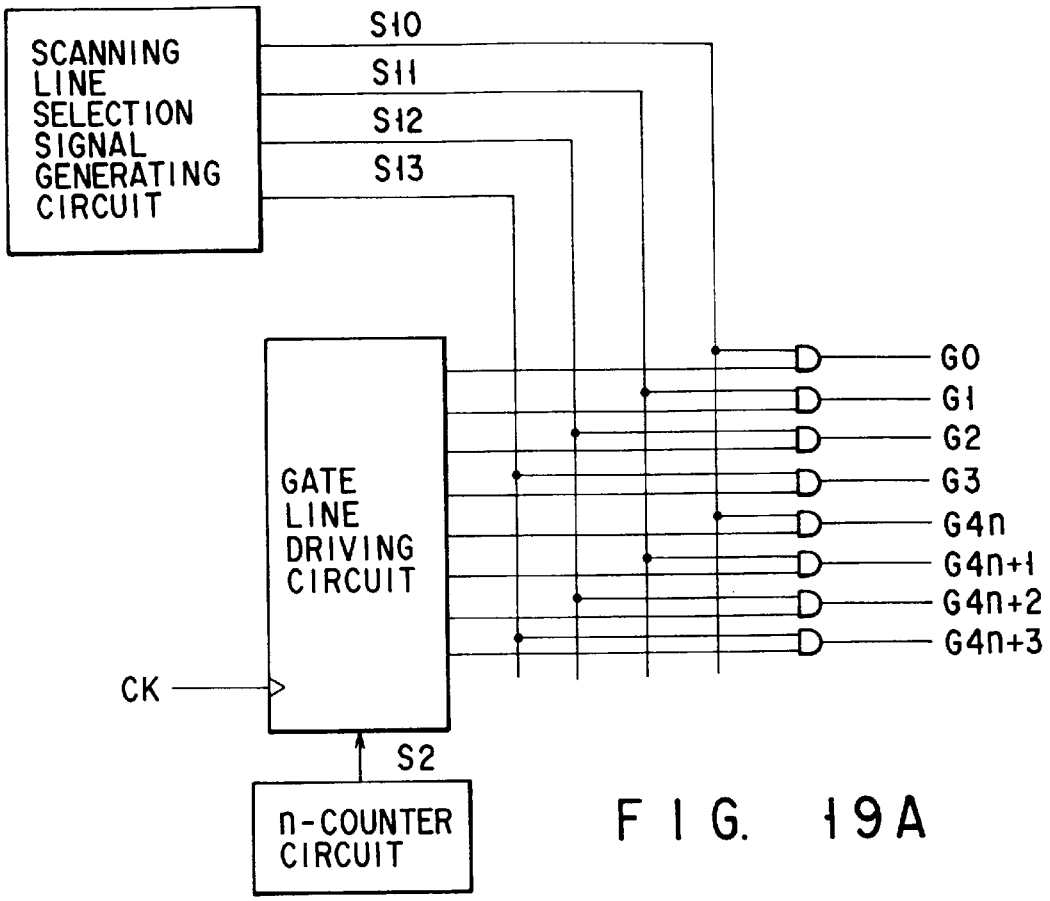
FIG. 19A is a block diagram showing a processing arrangement according to the modification of the fifth embodiment.
Figure 19B:
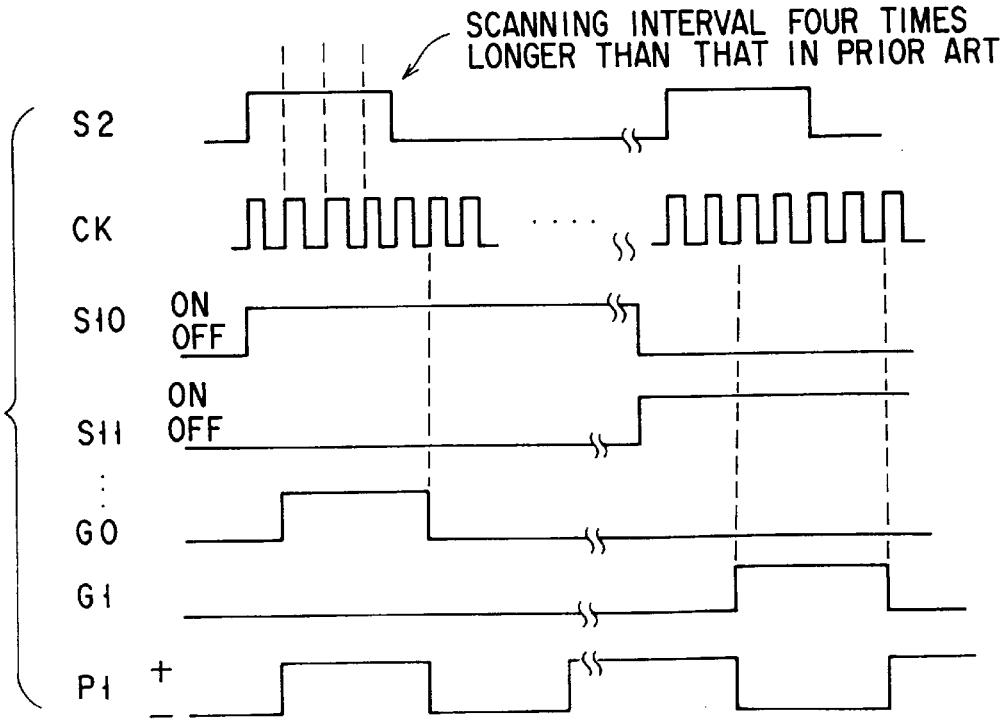
FIG. 19B is a timing chart showing the scanning line and polarity reversal cycles according to the modification of the fifth embodiment.

In addition, the write interval can be prolonged in synchronism with the polarity reversal cycle. For example, as shown in FIG. 19B, by prolonging the scanning line selection interval as compared with a normal selection interval, the write characteristics can be improved, and hence the image quality can be greatly improved. For example, FIG. 19A shows processing in a scanning line selection signal generating circuit 18 and a gate line driving circuit 13 in this case.

This processing is associated with the 4:1 multi-field driving method. More specifically, four scanning line selection signals S10, S11, S12, and S13 are output from a scanning line selection signal generating circuit to perform output control of scanning lines G4n, G4n+1, G4n+2, and G4n+3, respectively. In this case, a signal is output from S2 as a signal having a scanning line selection interval four times that of a signal in the case in which the multi-field driving method and the H inversion driving method are simply combined with each other. Assume that a signal for displaying a desired image is output from the signal line driver 16 to the signal lines.

(Sixth Embodiment)

The sixth embodiment uses the multi-field driving method of decreasing the driving frequency by dividing one frame (a one-frame image) into a plurality of sub-fields. Since the multi-field driving method is well known, a detailed description thereof will be omitted. The sixth embodiment is characterized in that the intervals between pixels or scanning lines in the respective sub-fields are made different from each other. The display color switching cycle can be made equal to or different from pixel or scanning line selection/non-selection cycle.

Figure 20:
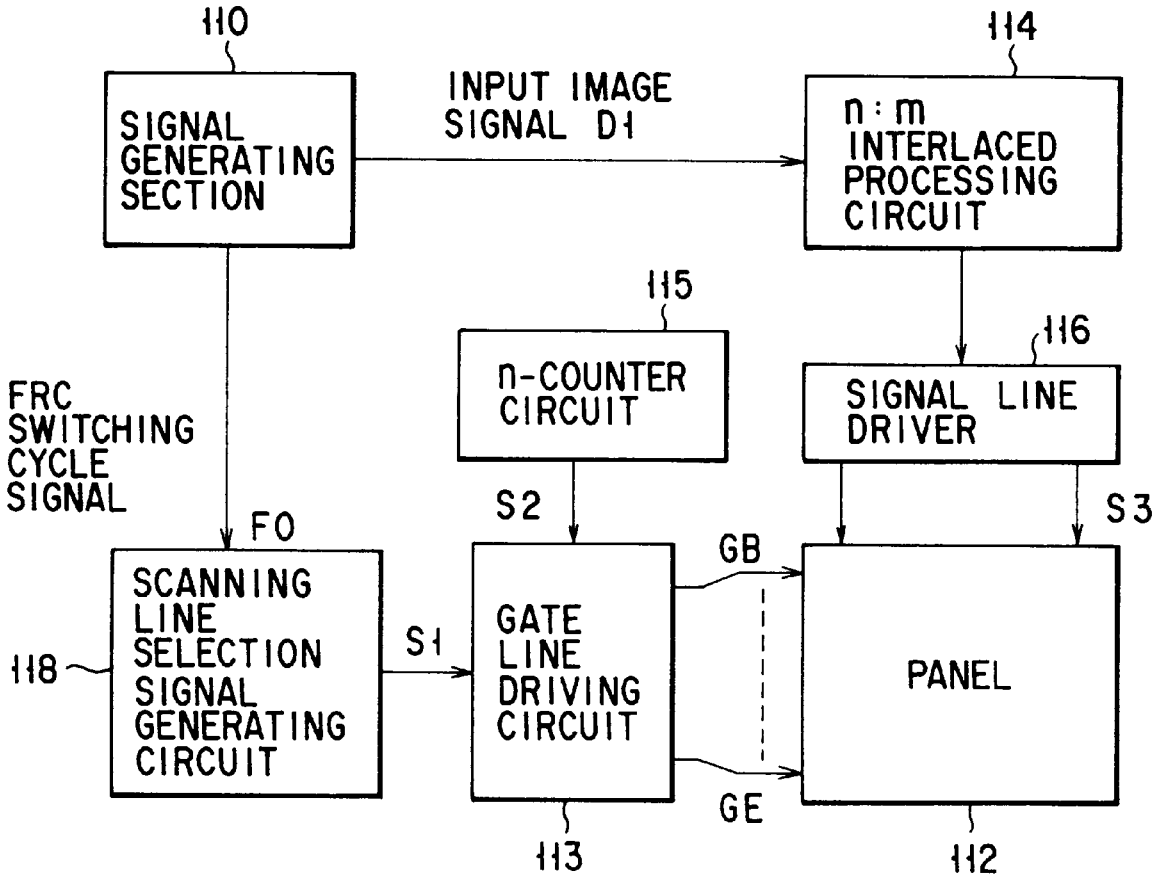
FIG. 20 is a block diagram showing the main part of a liquid crystal display device according to the sixth embodiment of the present invention.
Figure 21A:
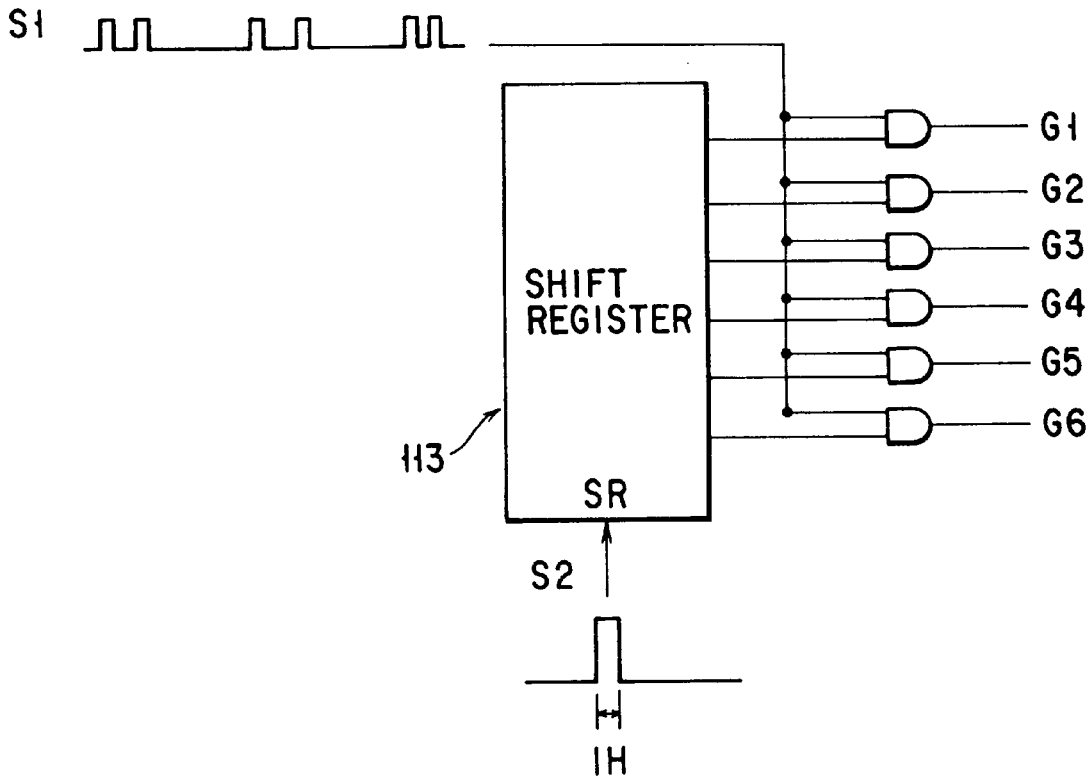
FIG. 21A is a block diagram showing the gate line driving circuit of the apparatus shown in FIG. 20.

FIG. 20 shows the arrangement of the main part of a liquid crystal display device according to the sixth embodiment. As shown in FIG. 20, the liquid crystal display device of this embodiment includes a signal generating section 110 for outputting an image signal including an FRC signal, a liquid crystal display panel 112, a gate line driving circuit 113, an image signal conversion means 114, an n-counter circuit 115, a signal line driver 116, and a scanning line selection signal generating circuit 118. FIG. 21A shows the arrangement of the gate line driving circuit 113.

In order to change the scanning line selection method in accordance with the display color switching cycle, an FRC switching cycle signal F0 indicating a display color switching cycle is input from the signal generating section 110 to the scanning line selection signal generating circuit 118. In response to this signal, a scanning line selection signal S1 is generated and input to the gate line driving circuit 113.

Note that the contents of processing performed by the image signal conversion means 14 are not specifically limited, but the circuit 14 performs processing for a reduction in display image degradation which poses problems in the prior art.

Figure 32A:
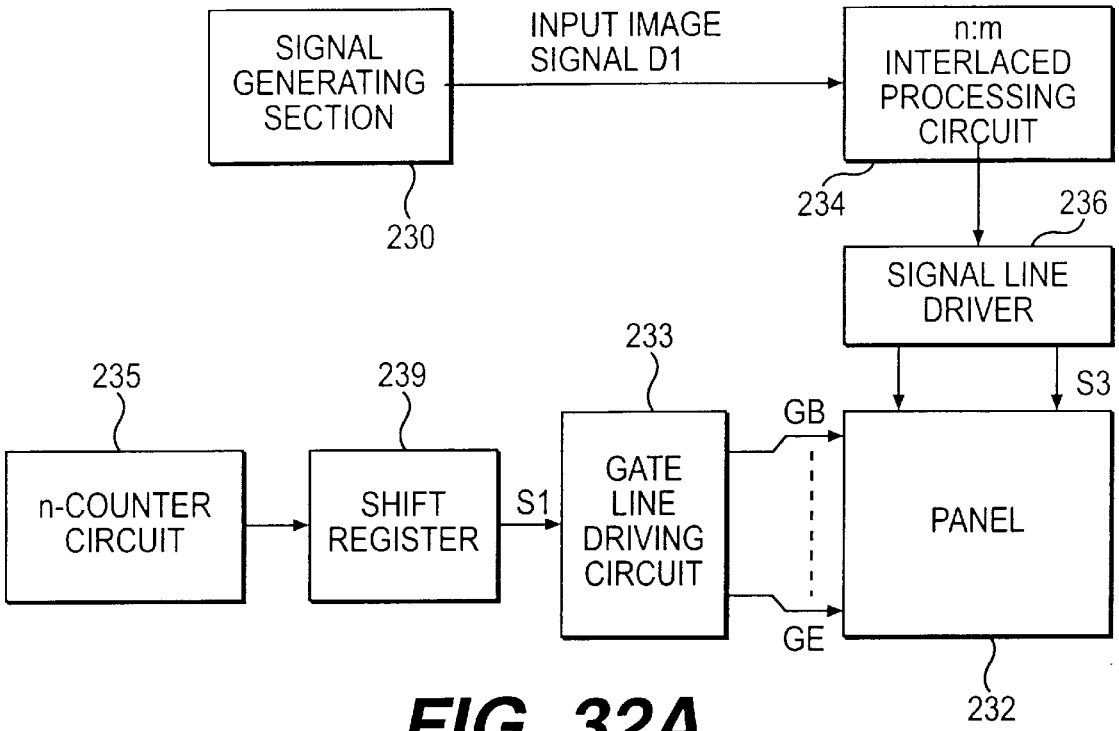
FIG. 32A PRIOR ART
FIGS. 32A and 32B are block diagrams showing the main part of a liquid crystal display device based on a conventional MF driving scheme.

FIG. 32A shows the arrangement of the main part of a conventional liquid crystal display device which performs multi-field driving with n=3 and m=1 (the number of sub-fields is 3÷1=3). As shown in FIG. 32A, this liquid crystal display device includes a signal generating section 230 for outputting an image signal containing an FRC signal, a liquid crystal display panel 232, a gate line driving circuit 233, and image signal conversion means 234, an n-counter circuit 235, a signal line driver 236, and a shift register 239.

Figure 32B:
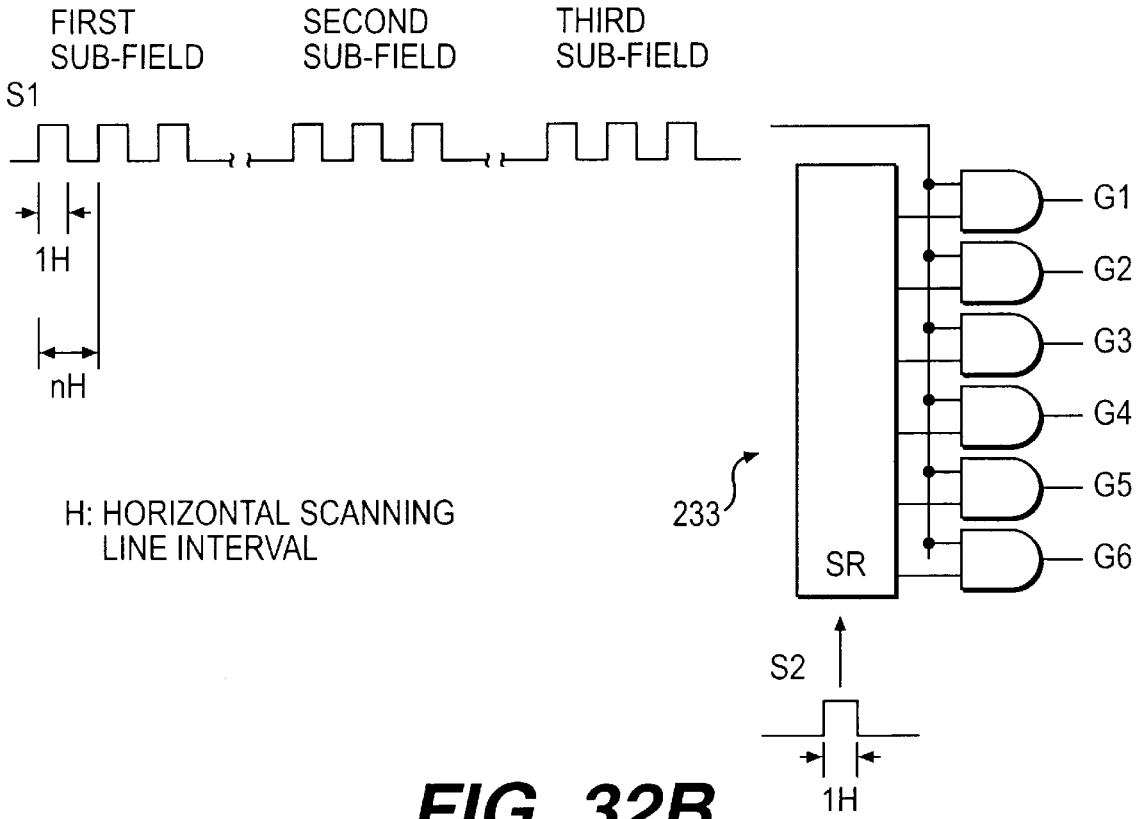
FIG. 32B PRIOR ART

As shown in FIG. 32B, the n-counter circuit 235 selects one scanning line per three scanning lines in each sub-field in accordance with a scanning line selection signal S1. In this case, the shift register 239 serves to sequentially select (line sequential selection) sub-fields in the next sub-field which are immediately below the corresponding scanning lines in a given sub-field.

Figure 33:
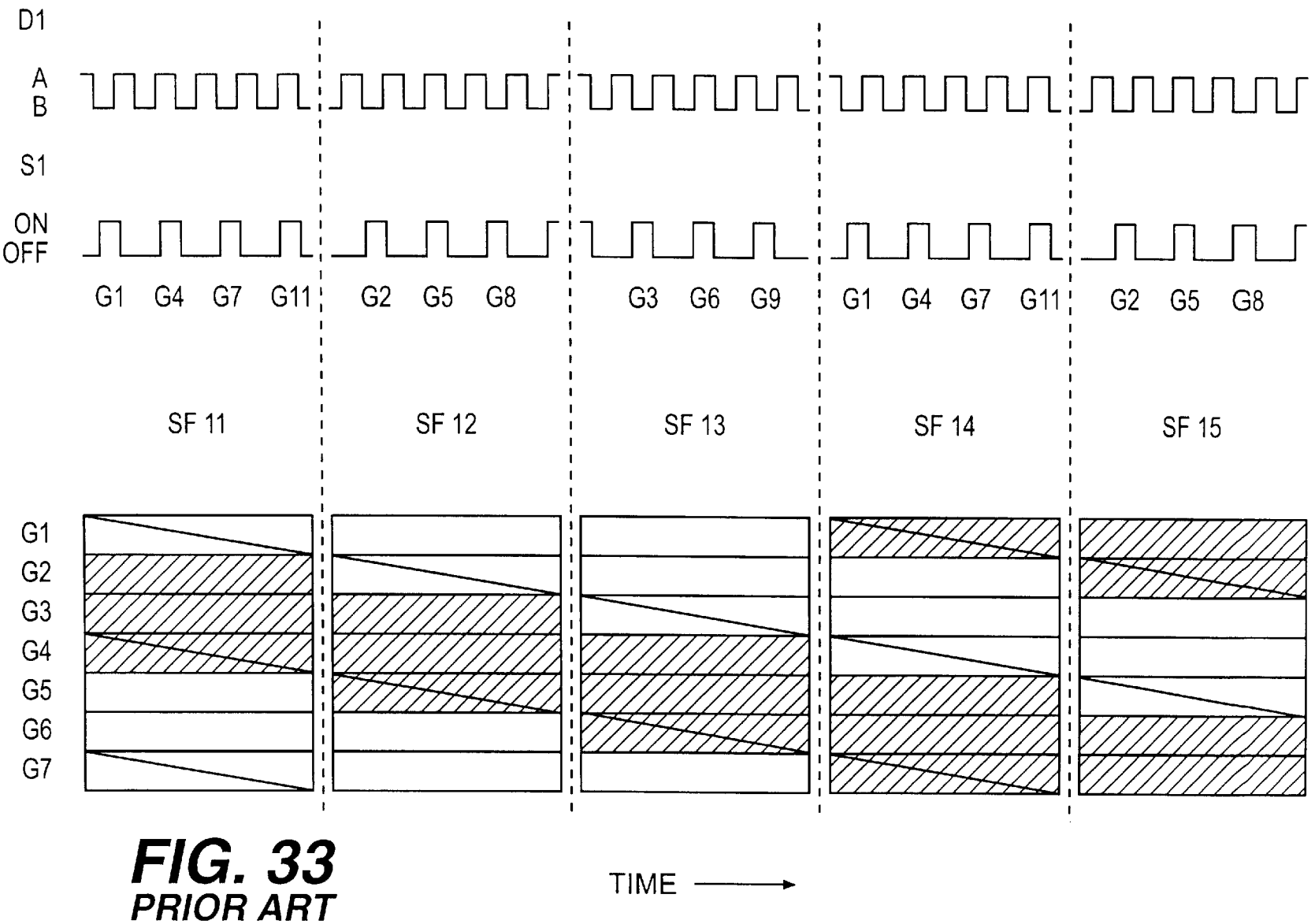
FIG. 33 PRIOR ART
FIG. 33 is a view showing the signal waveforms and the display image obtained when the conventional MF driving scheme is used.

FIG. 33 shows the input image signal (D1) and the scanning line selection signal S1 used when FRC is performed in the conventional method. For the sake of easy understanding, assume that a method of displaying a two-color halftone by using two display colors (display colors A and B) is used as an FRC processing method. Assume that in FRC processing, halftones are generally displayed while the display colors are switched in units of scanning lines and fields to improve the flicker characteristics.

FIG. 33 shows the image displayed on the panel on the basis of the signals, and the horizontal streaking which causes picture degradation. Referring to FIG. 33, the hatched portions indicate the display color A, and the portions other than the hatched portions indicate the display color B. The portions with the diagonal lines indicate the scanning lines selected in the respective sub-fields. In this case, each non-selected scanning line without a diagonal line maintains the display color set when each scanning line is selected last.

When the conventional multi-field driving method is used, since scanning is performed line sequentially throughout three sub-fields, the same color is displayed by the preceding and succeeding scanning lines, as shown in FIG. 33. As shown in FIG. 33, therefore, when one field is constituted by three sub-fields SF11 to SF13, three adjacent scanning lines of the same color are grouped. In addition, since the display colors are switched each field, the group of three scanning lines of the same color moves to cause horizontal streaking, resulting in picture degradation.

Figure 21B:
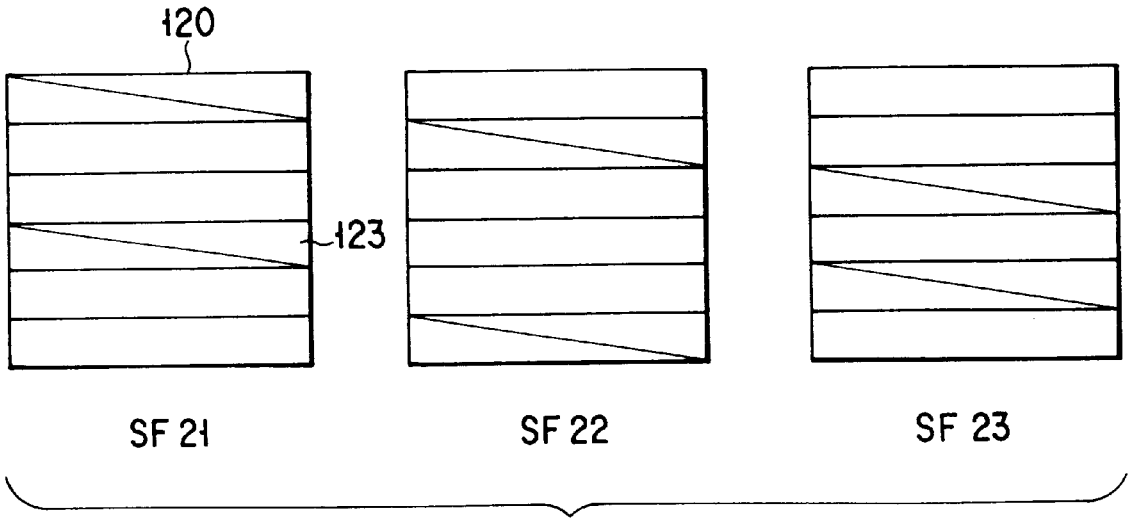
FIG. 21B is a view showing sub-fields in a driving method according to the sixth embodiment.

A method used in this embodiment will be described below. In this method, the scanning line selection signal S1 is input to the gate line driving circuit in accordance with the FRC switching cycle signal F0. Assume that n=6 and m=2 (the number of sub-fields is 6÷2=3), and the signal S1 for selecting the scanning lines with the diagonal lines in each sub-field is output, as shown in FIG. 21B. In this case, the pixels corresponding to scanning lines 120 and 123 are selected in a sub-field SF21, and three sub-fields SF21 to SF23 are formed in the same manner. In this embodiment, the image signal to be read by the image signal conversion means 114 decreases to ⅓ that in the prior art. Therefore, as is known well in the multi-field driving method, the driving frequency can be decreased, and the power consumed by the signal line driver 116, the gate line driving circuit 113, and the panel 112 can be reduced.

Figure 22:
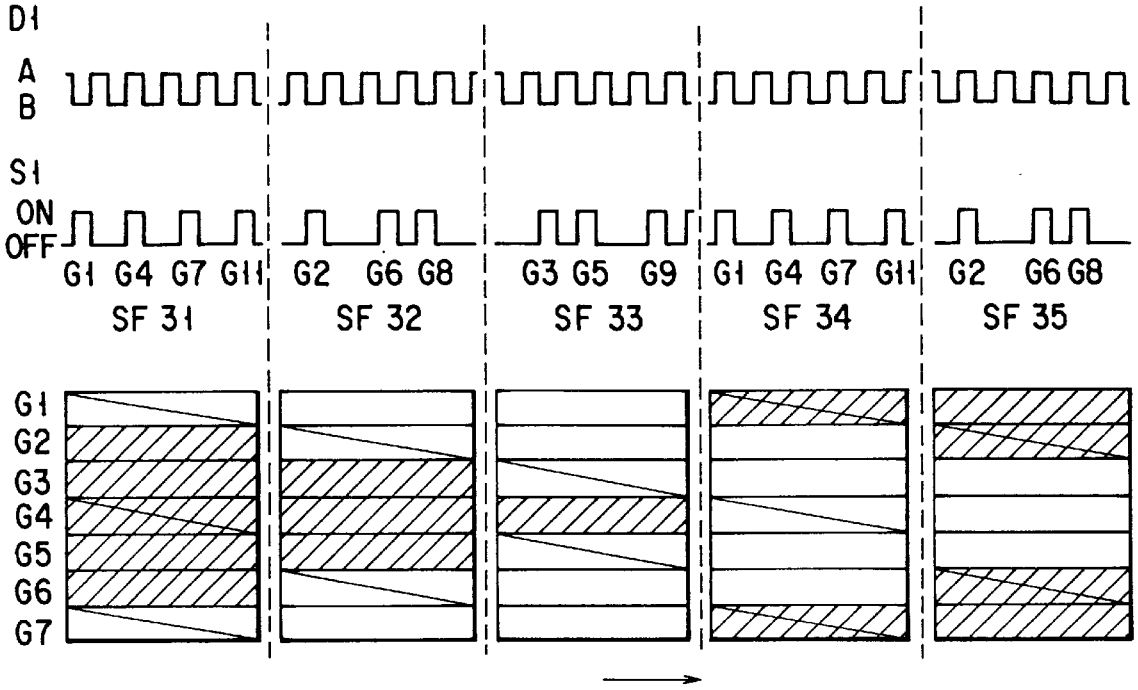
FIG. 22 is a view showing the signal waveforms and the display image obtained when the sixth embodiment is used.

FIG. 22 shows the input image signal (D1) and the scanning line selection signal S1 used when FRC is performed in this embodiment. For the sake of easy understanding, assume that a method of displaying a two-color halftone by using two display colors (display colors A and B) is used as an FRC processing method. Assume that in FRC processing, halftones are generally displayed while the display colors are switched in the respective fields to improve the flicker characteristics. In this embodiment, the input signal waveform is the same as that in FIG. 33, but the scanning line selection signal is controlled to select G1 and G4 in SF31; G2 and G6 in SF32; and G3 and G5 in SF33.

FIG. 22 shows the image displayed on the panel on the basis of the signals. Referring to FIG. 22, the hatched portions indicate the display color A, and the portions other than the hatched portions indicate the display color B. The portions with the diagonal lines indicate the scanning lines selected in the respective sub-fields. In this case, each non-selected scanning line without a diagonal line maintains the display color set when each scanning line is selected last.

When this n:m interlaced processing is performed, the number of adjacent scanning lines of the same color is more than n in some sub-fields. However, as shown in FIG. 22, since the width of the horizontal streak changes, and there is no horizontal streaking which is experienced when the scanning lines are scanned downward line sequentially, the temporal-spatial spectrum of the horizontal streak is dispersed and becomes difficult to visually recognize. At the same time, aliasing noise can be effectively reduced.

According to the above description, the input signal is subjected to 6:2 interlaced processing. However, this signal may be subjected to 3:2 interlaced processing to set the number of scanning lines of the same color to be equal to or smaller than 3. In addition, in processing all n:m (m<n) interlaced signals including a general n:1 interlaced signal, the intervals between scanning lines selected in the respective sub-fields can be made different from each other.

(Seventh Embodiment)

The seventh embodiment uses the multi-field driving method of decreasing the driving frequency by dividing one frame (a one-frame image) into a plurality of sub-fields (sub-images). Since the multi-field driving method is well known, a detailed description thereof will be omitted. The seventh embodiment is characterized in that the display color switching cycle is made different from the pixel/scanning line selection/non-selection cycle. In this case, the intervals between pixels or scanning lines selected in the respective sub-fields can be made equal to or different from each other.

Figure 23:
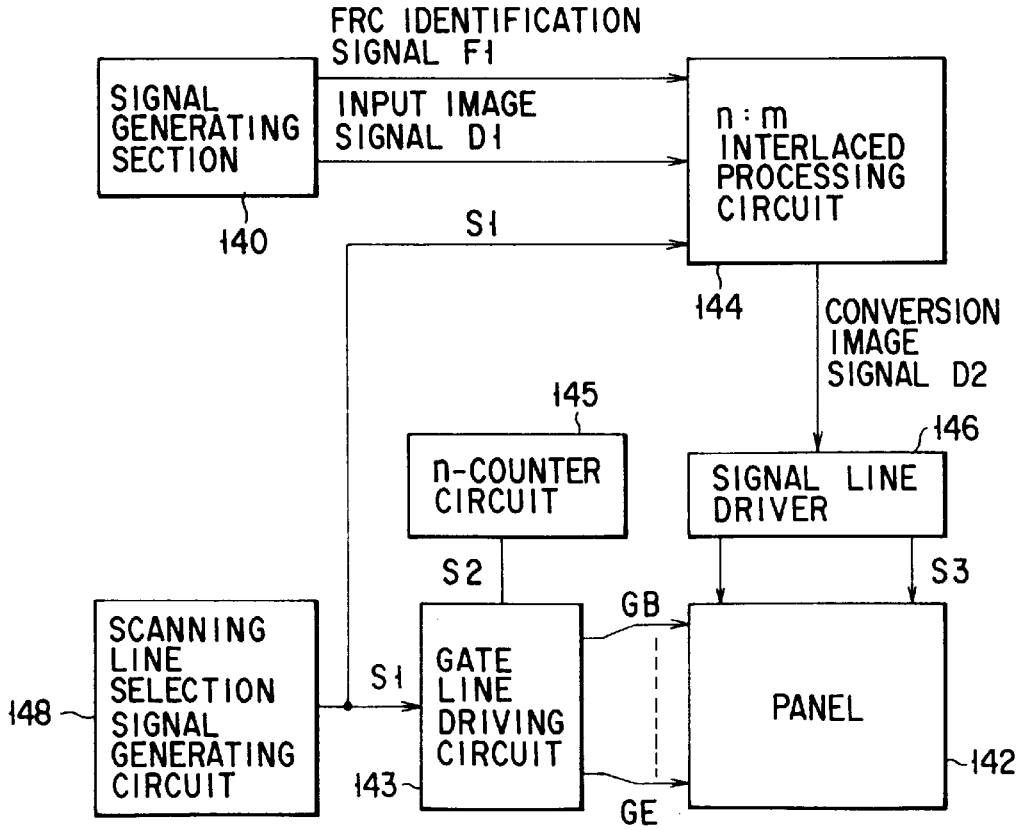
FIG. 23 is a block diagram showing the main part of a liquid crystal display device according to the seventh embodiment of the present invention.

FIG. 23 shows the arrangement of the main part of a liquid crystal display device according to the seventh embodiment. As shown in FIG. 23, the liquid crystal display device of this embodiment includes a signal generating section 140 for outputting an image signal containing an FRC signal, a liquid crystal display panel 142, a gate line driving circuit 143, an image signal conversion means 144, an n-counter circuit 145, a signal line driver 146, and a scanning line selection signal generating circuit 148.

In this embodiment, the display color switching cycle is changed in the image signal conversion means 144 on the basis of a signal S1 supplied from the scanning line selection signal generating circuit 148 and an FRC identification signal F1 supplied from the signal generating section 140. In this case, reference symbol F1 denotes a 1-bit signal for designating pixels for displaying an image by FRC.

Figure 24A:
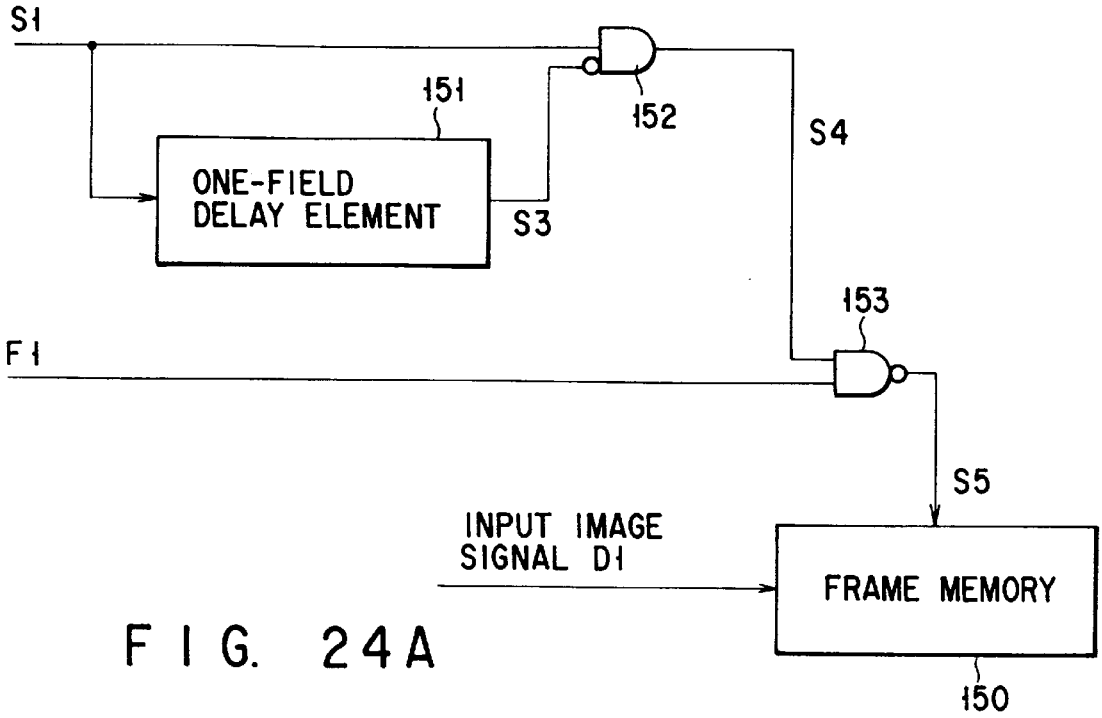
FIG. 24A is a block diagram showing a processing arrangement in an image signal conversion means according to the seventh embodiment.
Figure 24B:
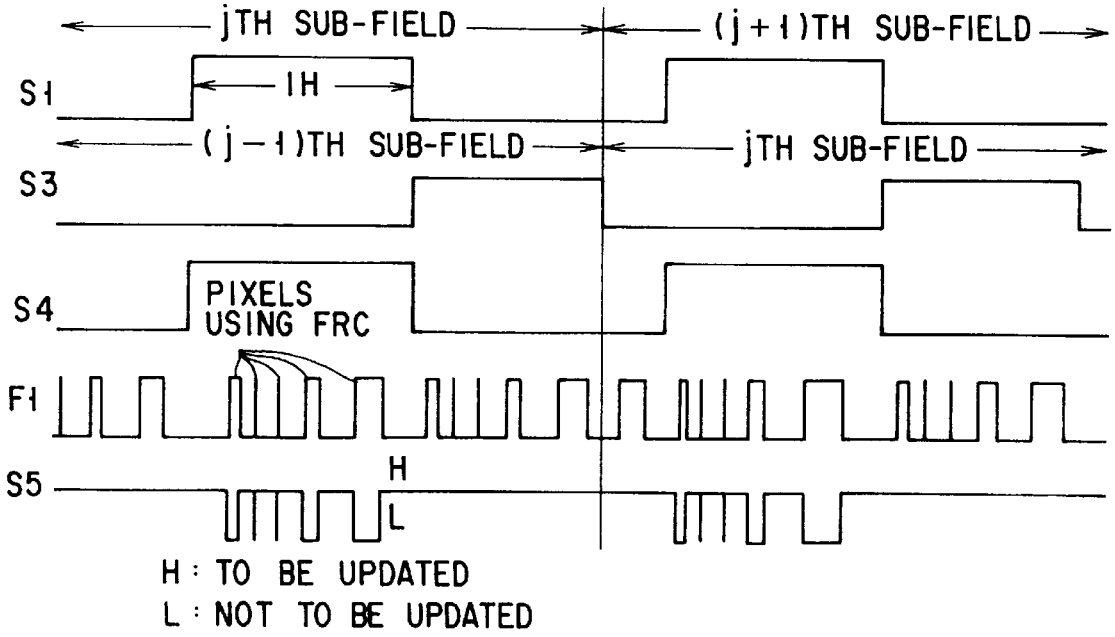
FIG. 24B is a timing chart showing the waveforms of signals at the respective portions corresponding to the processing arrangement in FIG. 24A.

Note that the contents of processing performed by the image signal conversion means 144 are not specifically limited, but the circuit 144 performs processing for a reduction in display image degradation which poses problems in the prior art. The contents of the processing performed by the image signal conversion means 144 will be described with reference to FIGS. 24A and 24B. FIGS. 24A and 24B respectively show the form of processing the scanning line selection signal S1 and the waveforms of signals at the respective portions.

For example, as shown in FIG. 24A, the image signal conversion means 144 may have a frame memory 150. When the FRC identification signal F1 and the scanning line selection signal S1 are input to the image signal conversion means 144, the data of the pixels using FRC is not updated in the frame memory 150. Therefore, the image signal for the pixels which is input to the signal line driver 146 is identical to the image signal input in the preceding sub-field.

This processing method is based on the condition that no scanning lines are selected in the preceding sub-field. For this reason, this device has a one-field delay element 151 for holding the state of the preceding sub-field for each scanning line. A logic operation section 152 performs a logical operation between the preceding sub-field and the succeeding sub-field to select scanning lines which are not selected in the preceding field and are selected in the succeeding sub-field. An address signal for pixels using FRC is output on the basis of the FRC identification signal F1, and is processed such that the data in the frame memory 150 in the image signal conversion means 144 is not updated on the basis of the logical operation result between the address signal and a signal S4 from the logic operation section 152. With this operation, the image information in the preceding sub-field which is associated with the pixels using FRC is held. A signal S5 from a logic operation section 153 in this embodiment corresponds to an enable signal used to input an image signal to the frame memory 150.

In this embodiment, if the one-field delay element 151, the logic operation section 152, and the logic operation section 153 are arranged in the image signal conversion means 144, the mounting area can be reduced. In addition, according to this embodiment, the information amount of the FRC identification signal F1 can be reduced.

Figure 25A:
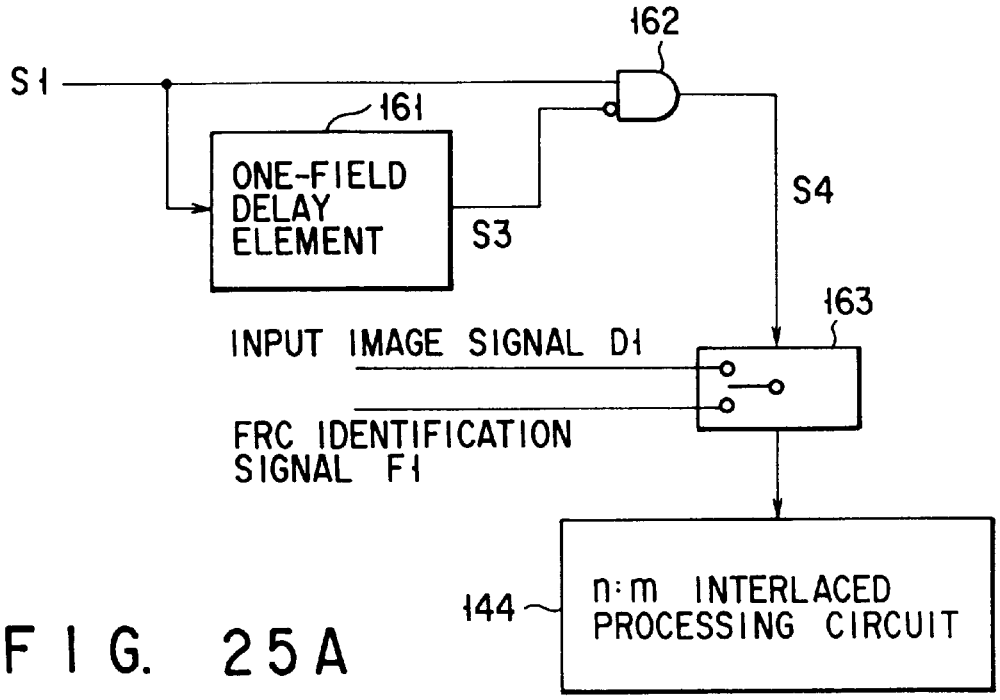
FIG. 25A is a block diagram showing another processing arrangement in the image signal conversion means in the seventh embodiment.
Figure 25B:
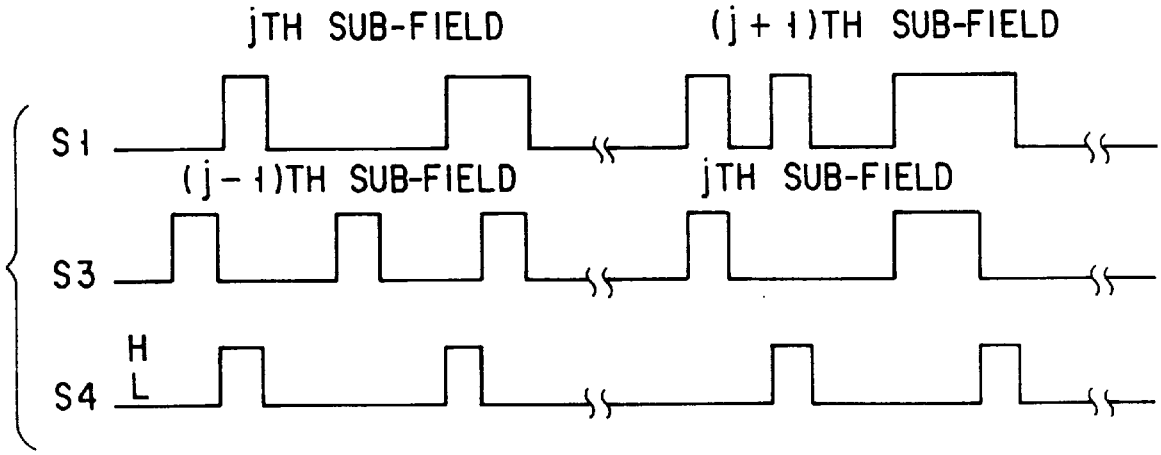
FIG. 25B is a timing chart showing the waveforms of signals at the respective portions corresponding to the processing arrangement in FIG. 25A.

A modification of the seventh embodiment will be described next with reference to FIGS. 25A and 25B. FIGS. 25A and 25B respectively show the form of processing the scanning line selection signal S1 and the waveforms of signals at the respective portions. In this modification, the image signal conversion means 144 has a frame memory, and the FRC identification signal F1 is image information representing one of the display colors constituting a halftone.

When, for example, a halftone is to be displayed by using two display colors A and B, the FRC identification signal F1 is image information representing the display color A or B. Display colors are therefore selected for pixels used to write a halftone such that adjacent pixels do not have the same color or the number of adjacent scanning lines of the same color is minimized.

For example, as shown in FIG. 25A, the scanning line selection signal S1 is input to a one-field delay element 161 to hold the selection information in the preceding sub-field. In the succeeding sub-field, the scanning line selection signal S1 is input to the one-field delay element 161. In addition, with regard to scanning lines continuously selected by a logic operation section 162, processing is performed to select the FRC identification signal F1 through a switch 163. With regard to the remaining scanning lines, an input image signal D1 is selected.

Note that the contents of processing performed by the logic operation section 162 are not specifically limited, but the section 162 performs processing for a reduction in display image degradation which poses problems in the prior art.

This modification requires another input stage for the image information F1 corresponding to the pixels for displaying a halftone. However, since the modification uses no memory, an increase in power consumption can be suppressed.

Figure 26:
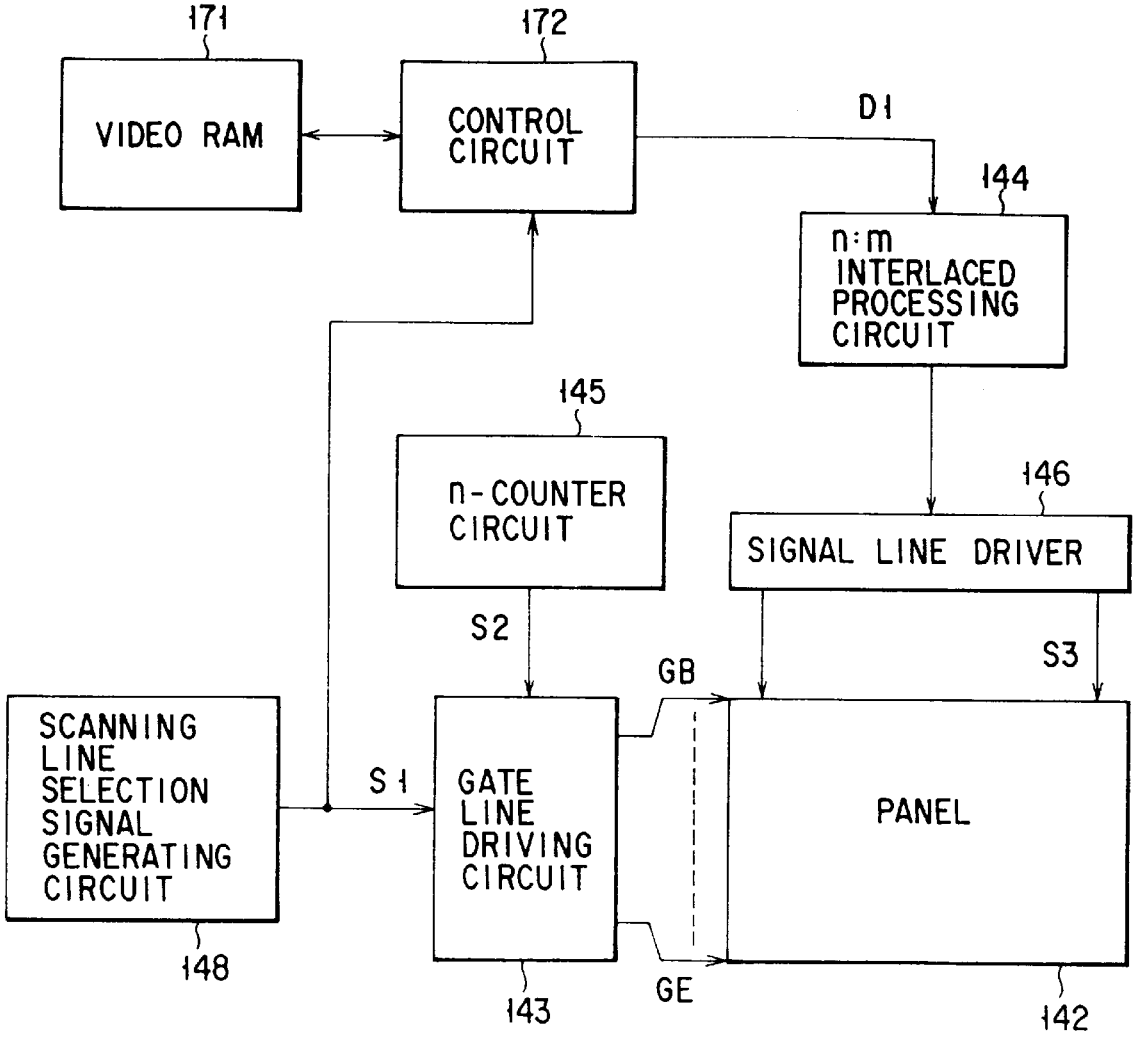
FIG. 26 is a block diagram showing an image signal conversion processing arrangement for FRC as a modification of the seventh embodiment.

Another modification of the seventh embodiment will be described next with reference to FIG. 26. In this modification, an input image signal is converted in accordance with the n:m interlaced processing means. As compared with the liquid crystal display device shown in FIG. 23, this liquid crystal display device is characterized by including a video RAM 171 and a control circuit 172, as shown in FIG. 26. In order to convert an input image in accordance with the n:m interlaced processing means, the scanning line selection signal S1 from the scanning line selection signal generating circuit 148 is input to the control circuit 172 mounted in the signal generating section or the information terminal body. The control circuit 172 designates addresses with respect to the video RAM 171 and changes the display color switching cycle.

For example, in a 3:1 interlaced processing means, since one frame is divided into three sub-fields, the display colors may be switched every three fields. That is, the control circuit 172 performs address designation for the pixels using FRC, and processes the image information to switch the display colors every three fields. The input image signal therefore has a signal waveform corresponding to this processing.

Figure 27:
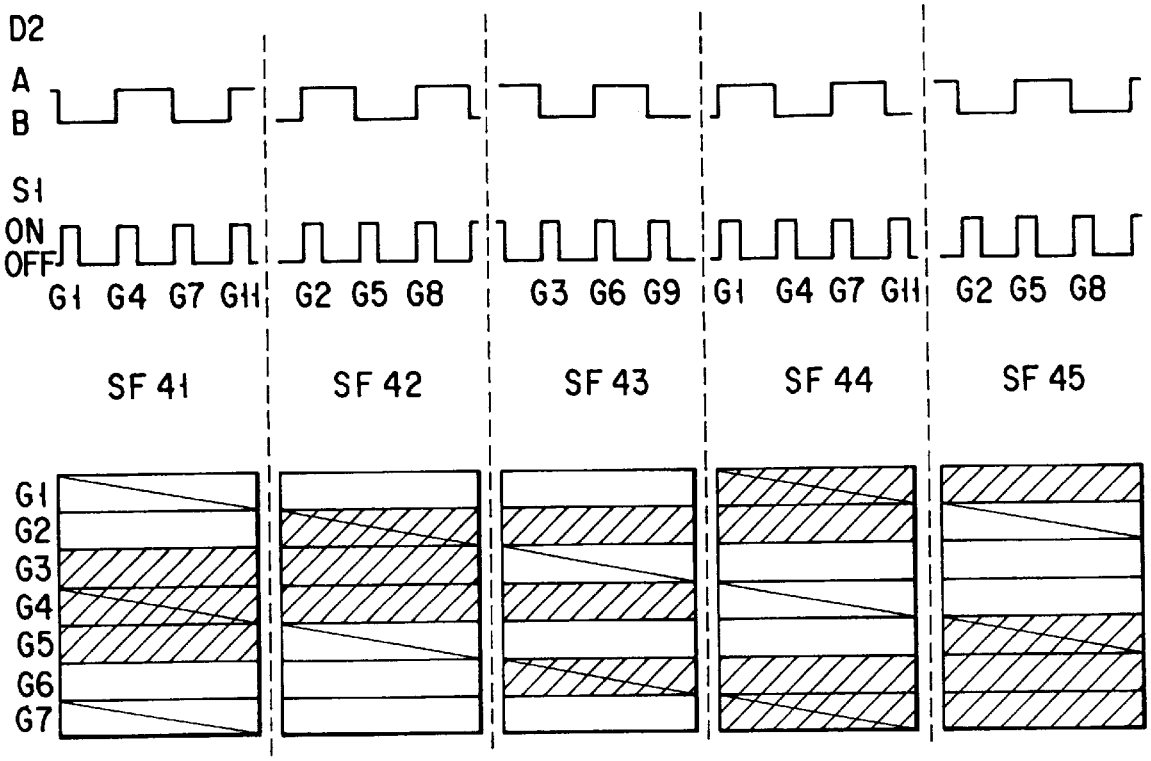
FIG. 27 is a view showing the signal waveforms and the display image obtained when the seventh embodiment is used.

FIG. 27 shows a conversion image signal D2 processed by the n:m interlaced processing means in the seventh embodiment, and a scanning line selection signal S1 for a conventional multi-field driving operation with n=3 and m=1 (the number of sub-fields is 3÷1=3). For the sake of easy understanding, assume that a method of displaying a two-color halftone by using two display colors (display colors A and B) is used as an FRC processing method.

According to the contents of FRC processing, a halftone is generally displayed by switching the display colors in units of scanning lines and fields. In the image signal conversion means 144, however, the display colors are switched every third scanning line and every sixth sub-field. In this case, since the image signal to be read by the image signal conversion means 144 is reduced ⅓ that in the prior art, the driving frequency can be decreased, and the power consumed by the signal line driver 146, the gate line driving circuit 143, and the panel 142 can be reduced, as in the multi-field driving method.

FIG. 27 shows the image displayed on the panel on the basis of the signals. Referring to FIG. 27, the hatched portions indicate positive polarity, and the plain portions indicate negative polarity. The portions with the diagonal lines indicate the scanning lines selected in the respective sub-fields. In this case, each non-selected scanning line without a diagonal line maintains the display color set when each scanning line is selected last.

With this operation, even with the use of the conventional multi-field driving method, the number of adjacent scanning lines of the same display color becomes three or less in three sub-fields, as indicated by SF43 in FIG. 27B, flickers are difficult to visually recognize. In addition, since a group of three adjacent scanning lines of the same color does not move, no horizontal streaking is produced.

Figure 28:
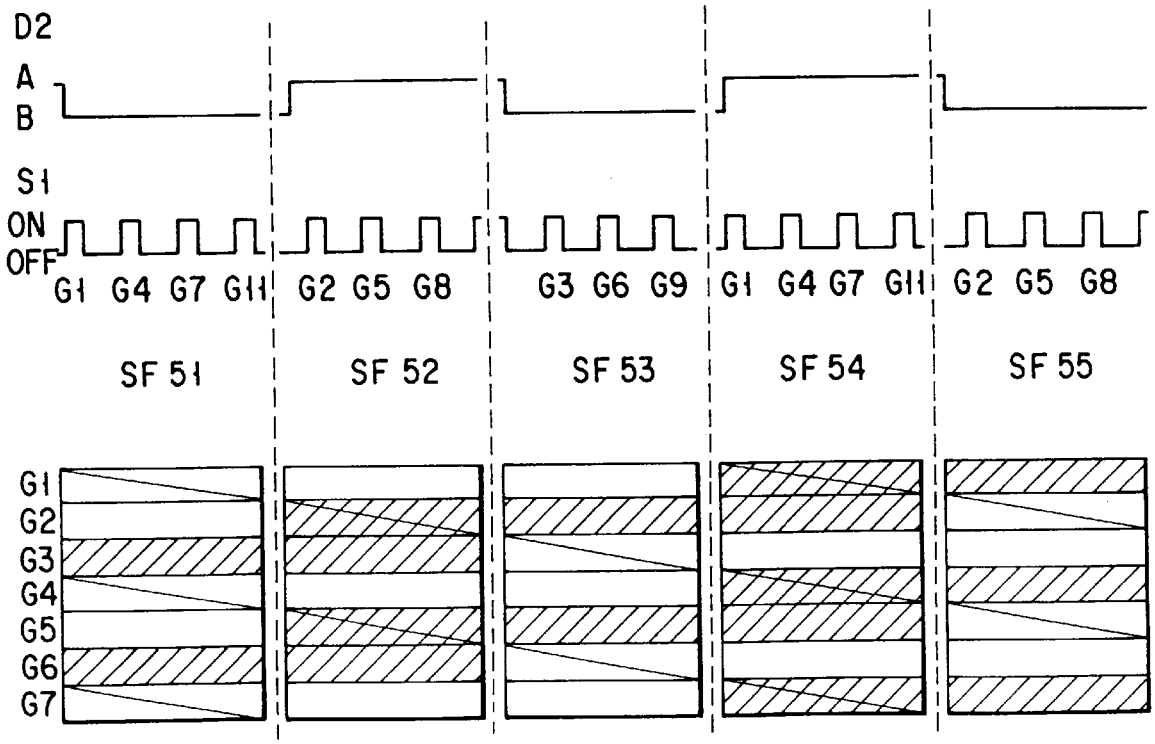
FIG. 28 is a view showing another examples of the signal waveforms and the display image obtained when the seventh embodiment is used.

FIG. 28 shows an example of changing the display color switching cycle in FIG. 27. In this case, as shown in FIG. 28, the display colors of the scanning lines in each sub-field are made uniform, but are switched in units of sub-fields.

FIG. 28 shows the image displayed on the panel on the basis of the signals. Referring to FIG. 27, the hatched portions indicate positive polarity, and the plain portions indicate negative polarity. The portions with the diagonal lines indicate the scanning lines selected in the respective sub-fields. In this case, each non-selected scanning line without a diagonal line maintains the display color set when each scanning line is selected last.

With this operation, the number of adjacent scanning lines of the display color A or B can be set to be two or less, and the spatial frequency can be increased. In addition, with the increase in spatial frequency, horizontal streaking is difficult to visually recognize.

In this case, since the image signal to be read by the image signal conversion means 144 is reduced ⅓ that in the prior art, the driving frequency can be decreased, and the power consumed by the signal line driver 146, the gate line driving circuit 143, and the panel 142 can be reduced, as in the multi-field driving method. In addition, since the voltage (for displaying the display color A or B) is kept constant in each sub-field, the power consumed by the signal line driver 146 and the liquid crystal display panel 142 can be reduced more effectively. This effect becomes conspicuous in proportion to the size of an image used for FRC.

According to the above description, an image signal is formed by the image signal conversion means 144 on the basis of an FRC identification signal, or an input image signal is formed in the video RAM 171 on the basis of pixels or a scanning line selection signal from the image signal conversion means 144. However, another method may be used to make the display color switching cycle differ from the scanning line selection/non-selection cycle.

As a pixel selection method used to form sub-fields in the sixth and seventh embodiments, a method which compensates for flickers in one frame to improve the image quality is preferably used. Horizontal streak interference depends on the luminance difference between the display colors. For this reason, the pixel or scanning line selection method and the display color switching cycle are preferably determined such that horizontal streak interference and aliasing noise caused by the interference do not occur with respect to an image signal having good visual sensitivity characteristics.

In addition, the sixth and seventh embodiments may be combined with each other. That is, the display color switching cycle is made different from the pixel/scanning line selection/non-selection cycle, and the intervals between pixels or scanning lines selected in the respective sub-fields are made different from each other.

(Eighth Embodiment)

Figure 29:
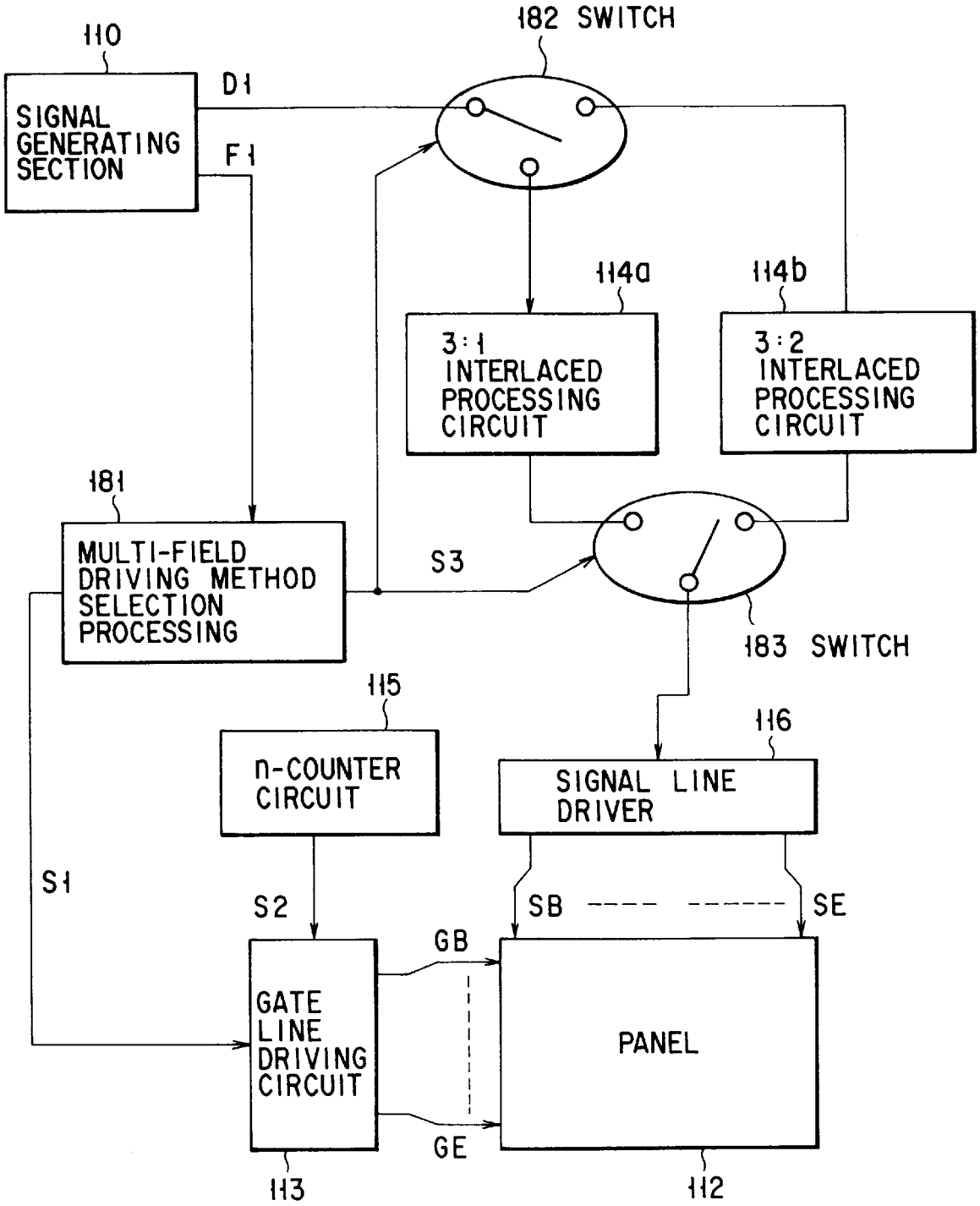
FIG. 29 is a block diagram showing the main part of a liquid crystal display device according to the eighth embodiment of the present invention.

In the present invention, since an image is displayed while the pixel/scanning line selection method is changed in accordance with the input image signal, processing in the image signal input section is required. In consideration of this point, a liquid crystal display device of the eighth embodiment has an arrangement obtained by improving the arrangement of the liquid crystal display device of the sixth embodiment shown in FIG. 20. As shown in FIG. 29, the device of the eighth embodiment includes a multi-field driving method selection processing section 181. This section selects an input image signal processing section in accordance with an FRC identification signal, and generates an image or a scanning line selection signal S1. In addition, the section 181 performs 3:2 interlaced driving for pixels using FRC; and 3:1 interlaced driving for pixels not using FRC.

Note that the contents of processing performed by the multi-field driving method selection processing section 181 are not specifically limited, but the section 181 performs processing for a reduction in display image degradation which poses problems in the prior art. When, for example, an FRC identification signal F1 is input to the multi-field driving method selection processing section 181, and scanning lines corresponding to pixels using FRC are designed by the signal F1, a scanning line selection signal S1 corresponding to the 3:2 interlaced processing means is input to a gate line driving circuit 113. In addition, a 3:2 interlaced processing circuit 114*b* corresponding to the interlaced processing means is selected by switches 182 and 183. In this case, the switches 182 and 183 are controlled in accordance with a control signal S3 from the multi-field driving method selection processing section 181. Similar processing is performed for scanning lines corresponding to pixels not using FRC, and the scanning line selection signal S1 for 3:1 interlaced processing and a 3:1 interlaced processing circuit 114*a* are selected.

According to this embodiment, when driving is performed in a predetermined pixel/scanning line selection order, if an image signal which tends to produce flickers is input, the selection method is changed in accordance with the image signal to make it difficult to visually recognize the flickers.

In the driving method of performing the driving operation in units of scanning lines, both an image using FRC and an image not using FRC may exist within a scanning line. In this case, for example, priority may be given to the image using FRC, and 3:2 interlaced driving can be performed with respect to the above scanning line. Alternatively, priority may be given to the image not using FRC, and 3:1 interlaced driving may be performed. The above interlaced driving operations may be switched by a switch in units of a plurality of sub-fields to perform a scanning operation.

When the selection method is changed, luminance irregularity may occur within the screen. However, such a problem can be solved by decreasing the luminance (Ia) at the time of switching and the luminance (Ib) before switching to a level or lower (e.g., 1/100 or lower) at which the luminance irregularity is not visually recognized at the contrast (ΔC) defined by the following equation:

$$\Delta C = abs\{(Ia-Ib)/(Ia+Ib)\}$$

where abs { } represents the absolute value of the value obtained by the mathematical expression within the brackets.

In order to compensate for this luminance irregularity, the value of m/n and the scanning line selection order may be changed between the preceding sub-field and the succeeding sub-field.

In order to compensate for a change in luminance on the screen which is caused when the value of m/n and the scanning line selection order are changed, this device may have a function of detecting the screen luminance in the preceding sub-field, and performing feedback control of the screen luminance in the succeeding sub-field.

Figure 30:
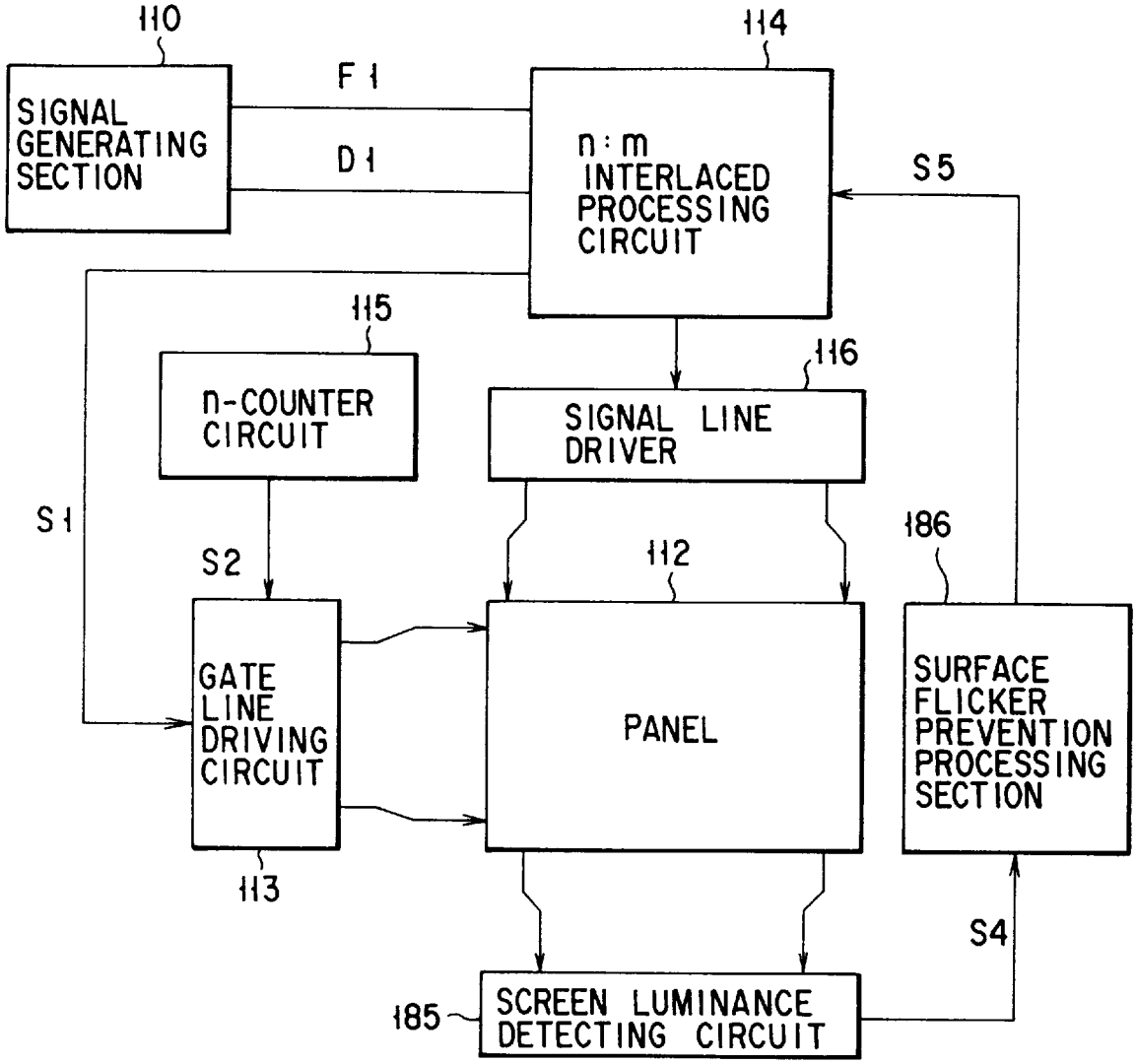
FIG. 30 is a block diagram showing the main part of a liquid crystal display device with a plane flicker prevention function according to a modification of the eighth embodiment.

FIG. 30 is a block diagram showing the arrangement of the main part of the liquid crystal display device to which a plane flicker prevention function is added.

Luminance information S4 obtained by a screen luminance detecting circuit 185 is input to a plane flicker prevention processing section 186. The plane flicker prevention processing section 186 can perform processing by the following method. A luminance difference which does not fall within a range in which flickers can be visually recognized according to special temporal flicker frequency of human vision is obtained in advance, and the selection order is changed in accordance with a logical operation based on the luminance difference information. With this processing, a signal S5 for controlling the value of m/n in the subsequent field is input to an image signal conversion means 114. Referring to FIG. 30, a multi-field driving method selection processing section, a control switch, and an n:m interlaced processing section are incorporated in the image signal conversion means.

When the value of m/n changes within the same frame, a luminance difference is caused by a driving frequency difference, resulting in luminance irregularity. An arrangement for compensating for this luminance irregularity will be described.

In this case, a luminance irregularity prevention processing section (186) is used in place of the plane flicker prevention processing section 186 in FIG. 30. In order to compensate for luminance irregularity, the screen luminance detecting circuit 185 is connected to a liquid crystal display panel 112. The screen luminance detecting circuit 185 detects the voltages applied to pixels set on the same gradation level and selected by different selection methods during the blanking interval. As the pixels to be detected, monitor pixels selected by different selection methods may be used.

The flicker prevention processing section (186) may perform correction by using a logical operation between the luminance difference between two pixels and the luminance difference which falls within the range in which flickers can be visually recognized. The resultant data is input to and processed by the image signal conversion means 114 to be fed back to an image signal for the next field.

(Ninth Embodiment)

Processing in the image signal input section is required to change the switching cycle of the display colors constituting an input halftone and convert an input image signal in accordance with the number of display colors.

Figure 31:
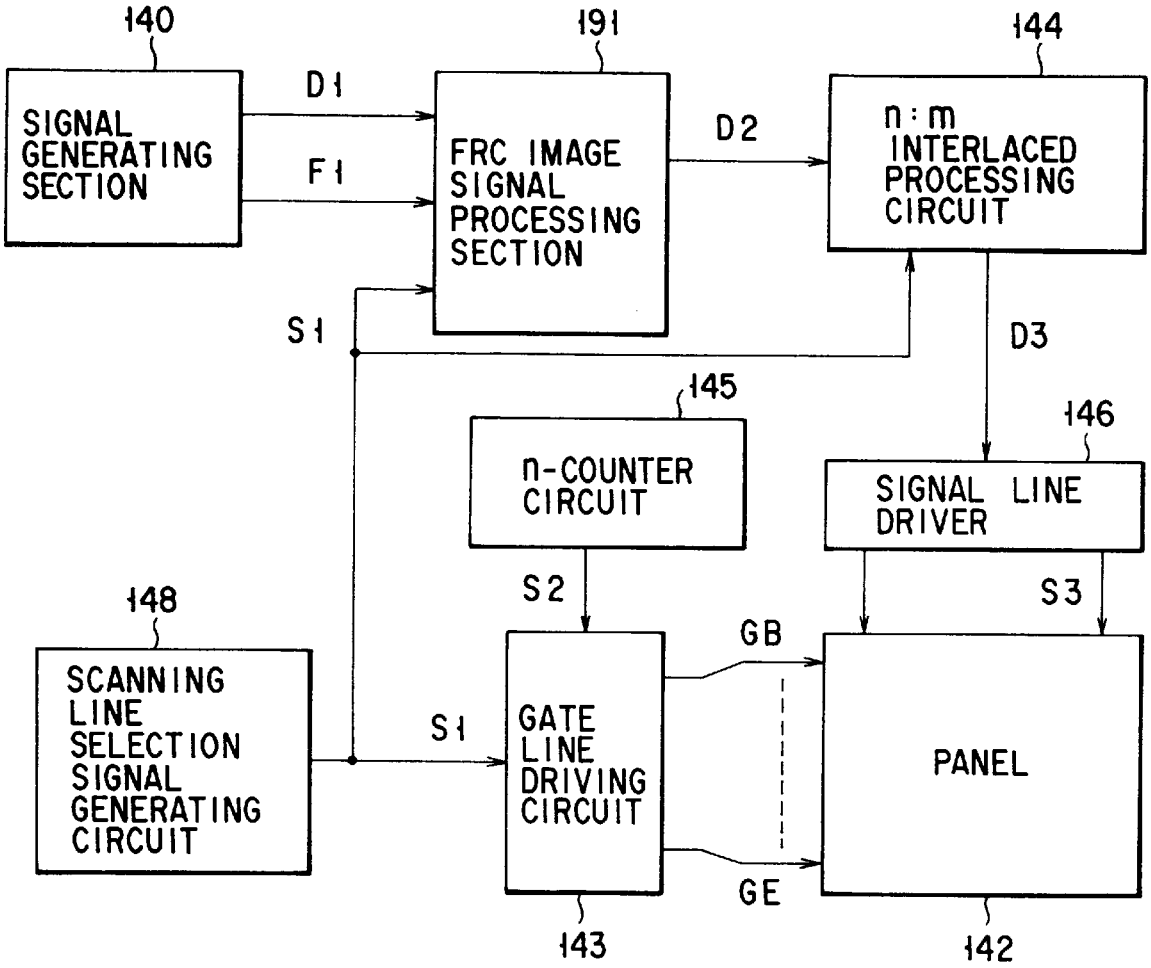
FIG. 31 is a block diagram showing the main part of a liquid crystal display device according to the ninth embodiment of the present invention.

As shown in FIG. 31, a liquid crystal display device of the ninth embodiment is equivalent to the conventional multi-field driving arrangement to which an FRC image signal processing section 191 is added. In this device, an input image signal obtained by converting only the display image corresponding to the FRC image is input to an image signal conversion means 144.

In this embodiment as well, the contents of processing performed by the FRC image signal processing section 191 are not specifically limited, but the section 191 performs processing for a reduction in display image degradation which poses problems in the prior art. For example, this processing can be performed by the processing arrangement in the sixth and seventh embodiments.

Referring to FIG. 31, an image signal D2 converted for an FRC signal is input to the image signal conversion means 144 and subjected to interlaced processing, thereby obtaining an image signal D3 for multi-field driving. For example, as a method of displaying a halftone, a method of using two, three, or more display colors constituting the halftone may be used. According to this method, the FRC image signal processing section 191 changes the display color switching cycle in accordance with the number of display colors using RFC, and outputs the resultant signal to the image signal conversion means 144.

For example, in performing 3:1 interlaced driving, if the number of display colors constituting a halftone is two, one frame is divided into six sub-fields. If the number of display colors constituting a halftone is three, one frame is divided into nine sub-fields. The number of display colors may be recognized by using an FRC identification signal. Basically, for a halftone constituted by k display colors, one frame is divided into k×n sub-fields. However, the number of sub-fields can be changed within the spirit and scope of the invention.

According to this embodiment, when an image signal which tends to cause horizontal streak interference under the condition of a predetermined switching cycle is input, since the display color switching cycle is changed in accordance with the image signal, such a horizontal streak is difficult to visually recognize. Surface flickers may occur with a change in switching cycle. However, no problem is posed if the switching cycle is changed to decrease the contrast below the level at which flickers cannot be visually recognized. Furthermore, in order to compensate for a change in luminance on the screen with a change in switching cycle, this device may have a function of detecting the screen luminance in the preceding sub-field, and performing feedback control of the screen luminance in the succeeding sub-field. As a means for compensating for a screen luminance, the means in the eighth embodiment can be used.

The liquid crystal display device of this embodiment includes a liquid crystal display panel 142, a signal generating section 140 for outputting an image signal containing an FRC signal, a signal line driver 146, an FRC image signal processing section 191, an image signal conversion means 144, and a gate line driving circuit 143. A scanning line selection signal is input to the gate line driving circuit 143 through a scanning line selection signal generating circuit 148. An image signal processed by the FRC image signal processing section 191 and the image signal conversion means 144 is input to the signal line driver 146. In order to compensate for plane flickers, the FRC image signal processing section 191 may perform signal processing upon while changing the switching cycle in units of sub-fields in accordance with the number of display colors constituting a halftone or the display color switching cycle.

The sixth to ninth embodiments are mainly associated with the case of n=3. However, the value of n and the limit number of adjacent scanning lines of the same color can be changed within the range in which flickers cannot be visually recognized according to special temporal flicker frequency of human vision.

The present invention is not limited to the above embodiments, and various changes and modifications can be made within the spirit and scope of the invention.

As has been described above, the liquid crystal display device of the present invention includes a pair of substrates, on at least one of which A pixels or scanning lines and switching elements for selecting the pixels or the scanning lines are arranged, a liquid crystal material sandwiched between the substrates, a driving means for driving a pixel group arrayed on each of selected scanning lines with the same polarity, and polarity reversal means for compensating for flickers by reversing the polarity. In this device, the display area is divided into n sub-fields for sequentially displaying one frame image along the time axis. Each of the sub-fields is basically constituted by A−n×m (where A is a positive integer, n is a positive integer ranging from 3 to A, and m is a positive integer equal to or smaller than n) pixels or scanning lines. Since the pixels or the scanning lines are selected at predetermined intervals in the respective sub-fields, picture degradation such as crosstalk can be prevented.

According to the present invention, by making the pixel/scanning line selection/non-selection cycle differ from the polarity reversal cycle, the number of adjacent pixels or scanning lines having the same polarity can be decreased, thereby making it difficult to visually recognize horizontal streak interference caused by such a group of pixels or scanning lines. In addition, since a horizontal streak does not move along the time axis, the image quality can be greatly improved according to special temporal flicker frequency of human vision.

According to the present invention, a write operation is performed at the speed twice that of a normal operation, and polarity reversal is performed in units of sub-fields, thereby greatly reducing the power consumed by the common electrode without degrading the image quality.

According to the present invention, leakage currents produced by the TFTs and the liquid crystal layer are controlled by changing the polarity reversal cycle during the holding interval. In addition, the holding characteristics in the positive and negative write operations are made uniform to greatly improve the image quality. Furthermore, the polarity of the common electrode is reversed to the polarity for the next write operation during the holding interval. With this operation, since a write operation can be performed while the voltage of the common electrode has risen to a desired voltage, the write characteristics can be optimized, and the image quality can be greatly improved.

According to the present invention, by prolonging the write interval in accordance with the polarity reversal cycle, the write characteristics with respect to the pixel electrodes can be improved, and the image quality can be greatly improved.

According to the present invention, the intervals between pixels or scanning lines selected in the respective sub-fields are made different from each other (the pixel/scanning line selection orders are made different from each other). With this operation, the number of adjacent pixels or scanning lines of the same display color which constitutes a halftone image in FRC can be decreased, thereby making it difficult to visually recognize horizontal streak interference caused by such a group of pixels or scanning lines. In addition, since a horizontal streak does not move along the time axis, the image quality can be greatly improved according to special temporal flicker frequency of human vision.

According to the present invention, the display color switching cycle is made different from the pixel/scanning line selection/non-selection cycle. With this operation, the number of adjacent pixels or scanning lines of the same color can be decreased, thereby making it difficult to visually recognize horizontal streak interference caused by such a group of pixels or scanning lines. In addition, since a horizontal streak does not move along the time axis, the image quality can be greatly improved according to special temporal flicker frequency of human vision. Furthermore, since the switching cycle in each sub-field can be shortened by changing the switching cycle, a further reduction in power consumption can be attained.

According to the present invention, by changing the value of m/n, i.e., the density and scanning order of pixels or scanning lines in each sub-field, depending on the image signal, desired image quality can be maintained in accordance with the image without luminance irregularity.

According to the present invention, the switching frequency of the display colors constituting a halftone is changed depending on the image signal to prevent flickers from being visually recognized, thereby maintaining desired image quality in accordance with the image.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A liquid crystal display device comprising:

a first substrate having lines of pixels, each line of pixels being connected to signal line electrodes;

a second substrate;

switching elements for selecting a line of said pixels;

a liquid crystal material sandwiched between said first and said second substrates, the liquid crystal material displaying halftones, a color of the halftones being determined based on an amplitude of a driving signal and the liquid crystal material displaying the same color even if a polarity of the driving signal is reversed;

driving means for supplying a driving signal having a predetermined polarity and an amplitude corresponding to a display color of each pixel to the signal line electrodes connected to a selected line of pixels, the polarity being constant for the line of pixels;

polarity reversal means for selectively reversing the polarity of the driving signal supplied to said selected line of pixels; and control means for controlling said switching elements and said polarity reversal means so as not to supply driving signals having the same polarity to a bundle of lines of pixels within one field, wherein a display area is divided into n sub-fields, each of the sub-fields is basically constituted by A÷n×m (where A is a positive integer indicating the number of lines of pixels within one field, n is a positive integer ranging from 3 to A and indicating the number of sub-fields within one field, and m is a positive integer not larger than n) lines of pixels, and lines of pixels are selected, in each of the sub-fields, at one of: fixed intervals in groups of at least two lines of pixels; and variable intervals.

2. The device according to claim 1, wherein intervals between the lines of pixels selected in the respective sub-fields are made equal to each other, and a cycle of reversing the polarity is made different from a cycle of selecting or non-selecting lines of pixels.

3. The device according to claim 2, wherein polarity reversal cycles in the respective sub-fields are made different from each other.

4. The device according to claim 1, wherein a display operation is performed while the intervals between the lines of pixels selected in the respective sub-fields are changed in accordance with the polarity reversal cycle.

5. The device according to claim 1, wherein the intervals between the lines of pixels selected in the respective sub-fields are made different from the polarity reversal cycle and the intervals between the lines of pixels selected in the respective sub-fields are made different from each other.

6. A driving method for a liquid crystal display device, said device including a first substrate having lines of pixels, each line of pixels being connected to signal line electrodes;

a second substrate;

switching elements for selecting a line of said pixels; and a liquid crystal material sandwiched between said first and said second substrates, the liquid crystal material displaying halftones, a color of the halftones being determined based on an amplitude of a driving signal and the liquid crystal material displaying the same color even if a polarity of the driving signal is reversed, wherein a display area is divided into n sub-fields, each of the sub-fields is basically constituted by A÷n×m (where A is a positive integer indicating the number of lines of pixels within one field, n is a positive integer ranging from 3 to A and indicating the number of sub-fields within one field, and m is a positive integer not larger than n) lines of pixels, and lines of pixels are selected, in each of the sub-fields, at one of: fixed intervals in groups of at least two lines of pixels; and variable intervals, said method comprising supplying a driving signal having a predetermined polarity and an amplitude corresponding to a display color of each pixel to the signal line electrodes connected to a selected line of pixels, the polarity being constant for the line of pixels, selectively reversing the polarity of the driving signal supplied to said selected line of pixels, and controlling said switching elements and the polarity reversal so as not to supply driving signals having the same polarity to a bundle of lines of pixels within one field.

7. The method according to claim 6, further comprising making intervals between the scanning lines selected in the respective sub-fields equal to each other, and making a cycle of reversing the polarity different from a cycle of selecting or non-selecting lines of pixels.

8. The method according to claim 7, further comprising making polarity reversal cycles in the respective sub-fields different from each other.

9. The method according to claim 6, further comprising performing a display operation while changing the intervals between the lines of pixels selected in the respective sub-fields in accordance with the polarity reversal cycle.

10. method according to claim 6, further comprising making the intervals between the lines of pixels selected in the respective sub-fields different from the polarity reversal cycle, and making the intervals between the lines of pixels selected in the respective sub-fields different from each.

11. A liquid crystal display device comprising:

a first substrate having lines of pixels, each line of pixels being connected to signal line electrodes;

a second substrate;

switching elements for selecting, in each of a plurality of sub-fields that form one field, lines of pixels at one of: fixed intervals in groups of at least two lines of pixels; and variable intervals;

a liquid crystal material sandwiched between said first and said second substrates, the liquid crystal material displaying halftones, a color of the halftones being determined based on an amplitude of a driving signal and the liquid crystal material displaying the same color even if a polarity of the driving signal is reversed;

driving means for supplying a driving signal having a predetermined polarity and an amplitude corresponding to a display color of each pixel to the signal line electrodes connected to a selected line of pixels, the polarity being constant for the line of pixels;

polarity reversal means for selectively reversing the polarity of the driving signal supplied to said selected line of pixels; and control means for controlling said switching elements and said polarity reversal means so as not to supply a driving signal having the same polarity to a bundle of lines of pixels within one field.

12. The device according to claim 11, wherein, under a control of said control means, lines of pixels are sequentially selected by said switching elements in a predetermined order, and the polarity of the driving signal supplied to the selected line of pixels is reversed by said polarity reversing means such that the bundle of lines of pixels having the same polarity is not produced within one field.

13. The device according to claim 11, wherein, under a control of said control means, the polarity of the driving signal supplied to the line of pixels is reversed in a predetermined order, and lines of pixels to which the driving signal is supplied are selected by said switching elements such that the bundle of lines of pixels having the same polarity is not produced within one field.

* * * * *